US006606945B1

(12) United States Patent
Shimatsu et al.

(10) Patent No.: US 6,606,945 B1
(45) Date of Patent: Aug. 19, 2003

(54) CONTINUOUS MEDIUM PRINTING APPARATUS

(75) Inventors: Katsuya Shimatsu, Kawasaki (JP); Yasuharu Takeuchi, Kawasaki (JP); Kiyoshi Chinzei, Hyogo (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 09/474,102

(22) Filed: Dec. 29, 1999

(30) Foreign Application Priority Data

Jul. 12, 1999 (JP) ..... 11-197752

(51) Int. Cl.[7] ..... B41F 13/56

(52) U.S. Cl. ..... 101/225; 101/DIG. 42

(58) Field of Search ..... 101/178, 181, 101/216, 217, 218, 219, 225, 227, 228, DIG. 42, 484, 485; 226/34, 35, 38, 193, 195

(56) References Cited

U.S. PATENT DOCUMENTS

| | | | | |
|---|---|---|---|---|
| 3,718,037 A | * | 2/1973 | Stringer et al. | 73/144 |
| 4,007,866 A | * | 2/1977 | Traise | 226/111 |
| 4,417,516 A | * | 11/1983 | Fischer | 101/181 |
| 4,722,275 A | * | 2/1988 | Taguchi et al. | 101/228 |
| 5,461,470 A | | 10/1995 | De Cock et al. | |
| 5,511,712 A | * | 4/1996 | Holm et al. | 226/11 |
| 5,890,050 A | | 3/1999 | Kaneda | 399/403 |
| 5,904,094 A | * | 5/1999 | Bredenberg | 101/216 |
| 5,921,453 A | * | 7/1999 | Suzuki | 226/92 |
| 5,927,196 A | * | 7/1999 | Murray | 101/219 |

FOREIGN PATENT DOCUMENTS

| | | |
|---|---|---|
| JP | 61-094960 | 5/1986 |
| JP | 3-16364 | 1/1991 |
| JP | 4-121353 | 4/1992 |
| JP | 4-173647 | 6/1992 |
| JP | 5-303287 | 11/1993 |
| JP | 5-322681 | * 12/1993 |
| JP | 7104586 | 4/1995 |
| JP | 7-261575 | 10/1995 |
| JP | 7-261576 | 10/1995 |
| JP | 7276721 | 10/1995 |
| JP | 9-301614 | 11/1997 |
| JP | 10035910 | 2/1998 |
| JP | 10-274892 | 10/1998 |
| JP | 11-38786 | 2/1999 |

* cited by examiner

*Primary Examiner*—Ren Yan
(74) *Attorney, Agent, or Firm*—Armstrong, Westerman & Hattori, LLP

(57) ABSTRACT

Disclosed herein is a continuous medium printing apparatus for performing printing on both sides of a continuous medium. The continuous medium printing apparatus comprises: a conveyance system; a printing section; a feed-force adjustment section disposed on a downstream side of the conveying path from the printing section; and a feed-force control section. The conveyance system has a pair of conveyor rollers disposed on a downstream side of the conveying path from the printing section so that they are opposite to each other with the continuous medium therebetween, feed force being applied to the continuous medium by rotating the pair of conveyor rollers with said continuous medium clamped therebetween. The feed-force adjustment section varies said feed force by adjusting pressure of said pair of conveyor rollers with respect to the continuous medium. With this arrangement, the behavior of the continuous medium in the printing section is stabilized, and consequently, print trouble near the perforations in the continuous medium can be prevented.

17 Claims, 12 Drawing Sheets

FIG. 3

| | PRINT TROUBLE AREA | |
|---|---|---|
| SCUFF FORCE | 55Kg/m$^3$ | 135Kg/m$^3$ |
| 20g/cm | 0~3mm | 25~30mm |
| 35g/cm | 0~2mm | 5~15mm |
| 50g/cm | 0~2mm | 3mm |

FIG. 4

| CIRCUMFERENTIAL VELOCITY (%) | PRINT TROUBLE AREA |
|---|---|
| +2.0 | 0~2mm |
| +0.5 | 0~1mm |
| +0.2 | 0~2mm |
| 0 | 0~4mm |
| -0.2 | 0~7mm |

FIG. 7

| PAPER BASIS WEIGHT | SECOND TRANSFERRING PROCESS UNIT | | FIRST TRANSFERRING PROCESS UNIT | |
|---|---|---|---|---|
| | VS2(V) | IT2(μA) | VS1(V) | IT1(μA) |
| 45Kg/m$^3$ | 700 | 400 | 700 | 300 |
| 55Kg/m$^3$ | 750 | 500 | 750 | 400 |
| 135Kg/m$^3$ | 800 | 600 | 650 | 400 |

CONTINUOUS MEDIUM PRINTING APPARATUS

BACKGROUND OF THE INVENTION (1) Field of the Invention

The present invention relates generally to a continuous medium printing apparatus, and more particularly to a continuous medium printing apparatus suitable for use as a printer that performs printing on both sides of continuous paper formed at predetermined intervals with perforations by an electrophotographic method.

(2) Description of the Related Art

In continuous paper (continuous medium) on which printing is performed by a continuous medium printing apparatus, there is one in roll form and one folded and stacked at predetermined intervals. Furthermore, in some continuous paper, a plurality of perforations are formed in parallel with the lateral direction of the continuous paper at regular intervals depending on paper size. The continuous paper with perforations can easily be stacked by alternately folding it into mountains and valleys at the perforations or can easily be cut at the perforations.

A conventional continuous medium printing apparatus, which performs printing on both sides of such continuous paper by an electrophotographic method, attaches, for example, continuous paper folded and stacked alternately into mountains and valleys at perforations to a paper hopper. This continuous paper is conveyed while it is being stretched successively by a conveyance system. In an image forming process section, toner images are formed on the obverse and reverse sides of the continuous paper by image forming drums, respectively. Furthermore, the toner images formed on both sides of the continuous paper are fixed by image fixing sections, respectively. In this manner, duplex printing is performed on the continuous paper.

FIG. 13 shows the stretched continuous paper 1. If the continuous paper 1, folded and stacked alternately into mountains and valleys at perforations 1*a*, is stretched in order to perform printing, mountains and valleys with perforations 1*a* as apices will be produced in the continuous paper 1, as shown in FIG. 13.

Because of the mountains and valleys with perforations 1*a* as apices, in the image forming process section, a space will arise between the image forming drum, which transfers a toner image to the continuous paper 1, and the continuous paper 1 and therefore a print trouble area will arise near the perforations 1*a*.

There are cases where when printing is performed on continuous paper, an identification mark or the like is printed near the perforations 1*a*. In such a case, it is desirable to make such a print trouble area as small as possible.

Hence, in the continuous medium printing apparatus, the conveyance system is provided with a scuff section, which is constituted by a scuff roller and a pinch roller disposed opposite to each other at a downstream position of the conveying path of the continuous paper 1 from the image forming process section and the image fixing section. In this scuff section, the continuous paper 1 is conveyed by freely sliding and rotating the scuff roller in the conveying direction of the continuous paper 1, with the continuous paper 1 clamped between the scuff roller and the pinch roller. That is, the continuous paper 1 is stretched by the scuff force (feed force) produced by the scuff roller in the scuff section, and the tension produced in the continuous paper 1 makes the mountains and valleys (unevenness) at the perforations 1*a* smaller, thereby stabilizing the behavior of the continuous paper 1 in the image forming process section.

Note that the difference d (see FIG. 13) between the mountain and the valley at the perforations 1*a* in the above-mentioned continuous paper 1 varies depending on the kind of the continuous paper 1, that is, paper basis weight (paper thickness), paper stem, paper size and the like. As shown in FIG. 13, the difference d between the mountain and the valley is defined, for example, as a distance measured in the direction perpendicular to the paper conveying direction.

However, there are cases where the conventional continuous medium printing apparatus cannot cope with various kinds of continuous paper, because of scuff force produced by the scuff section is constant. For instance, in changing the kind of the continuous paper 1, if scuff force is too strong, paper tear will occur at the perforations 1*a* or there is a possibility that the feed holes formed at regular intervals in the continuous paper 1 will crumble. If, on the other hand, scuff force is insufficient, the continuous paper 1 cannot be sufficiently tensioned, and consequently, there is also a possibility that printing quality will be degraded.

There is also a continuous medium printing apparatus provided along the conveying path of the continuous paper with a plurality of image forming drums for forming images on the continuous paper. In such a continuous medium printing apparatus, however, it is difficult to stretch the continuous paper 1 in each of a plurality of image forming process sections, by the feed force produced by the scuff section disposed at a downstream position of the conveying path of the continuous paper 1 from the image forming process section. Particularly, in the image forming drum disposed at a position away from the scuff section along the conveying path of the continuous paper 1, there is also a problem that print trouble will easily occur near the perforations 1*a*.

In addition, in the continuous medium printing apparatus which performs printing on both sides of the continuous paper 1, unevenness near the perforations la in the continuous paper 1 cannot be effectively removed by the feed force produced by the scuff section, because a guide member, a roller and the like, which apply tension to the continuous paper 1 in contact with the opposite side of the continuous paper 1 from the image forming drum, cannot be provided near the image forming process section in order to protect the unfixed toner images formed on both sides of the continuous paper 1.

Furthermore, in the scuff section, the continuous paper 1 is conveyed with the frictional force produced between the outer circumferential surface of the scuff roller and the continuous paper 1, but there are cases where the coefficient of surface friction of the continuous paper 1 is reduced due to matter such as ink or dust on the continuous paper land the like. As a result, there is also a fear that because of the reduction in the coefficient of friction, (1) the feed force produced by the scuff section will be reduced, (2) the continuous paper 1 will slacken because it cannot be stretched, and (3) the contact of the continuous paper 1 with the guide surface or the glass surface of the fixer in the conveying path will damage a formed printed image and reduce printing quality or will damage the guide surface or the fixer.

Incidentally, in order to prevent the occurrence of print trouble near the perforations 1*a* in the continuous paper 1, a method is known which stabilizes the behavior of the continuous paper 1 in the image forming drum, by disposing tractors for paper conveyance (tractor mechanisms), respectively, at upstream and downstream positions of the conveying path of the continuous paper 1 from the image forming drum and by conveying the continuous paper 1 with the feed pins of the tractor mechanisms fitted into feed holes formed at regular intervals in the laterally opposite portions of the continuous paper 1.

Such a method, however, requires a large space for installing the tractor mechanisms. Therefore, in a continuous medium printing apparatus provided within the same case with a plurality of image forming drums, like a duplex printing apparatus which performs printing on both sides of the continuous paper 1 by an image forming drum for the obverse side and an image forming drum for the reverse side, the tractor mechanisms have to be disposed between these image forming drums in the paper conveying path, and consequently, there is a problem that the size of the apparatus cannot be reduced.

In addition, in the method of disposing tractor mechanisms, respectively, at upstream and downstream positions of the conveying path of the continuous paper 1 from the image forming drum, there is also a problem that when printing is performed on pinless continuous paper having no feed holes, the behavior of the continuous paper in the image forming drum cannot be stabilized.

Furthermore, in order to prevent the occurrence of print trouble near the perforations 1*a* in the continuous paper 1, a method of varying transfer voltage at an area near the perforations 1*a* is disclosed in Japanese Laid-Open Patent Publication No. HER 7-261575. Also, a method of applying an electric potential of the opposite polarity from the surface potential of the image forming drum or the like to the continuous paper 1 is disclosed in Japanese Laid-Open Patent Publication No. HEI 5-303287. Furthermore, a method of applying pressure to the continuous paper 1 prior to the transfer of an image in the image forming process section is disclosed in Japanese Laid-Open Patent Publication No. HEI 7-261576. These methods, however, cannot remove unevenness near to the perforations 1*a* in the continuous paper 1 or the deflection of the continuous paper 1.

SUMMARY OF THE INVENTION

The present invention has been made in view of the aforementioned problems. Accordingly, it is an object of the present invention to provide a continuous medium printing apparatus which is capable of preventing the occurrence of print trouble in the vicinity of the perforations in the continuous medium by stabilizing the behavior of the continuous medium in the printing section.

To achieve the above object, the continuous medium printing apparatus of the present invention, which performs printing on both sides of a continuous medium, comprises a conveyance system, a printing section, a feed-force adjustment section, and a feed-force control section. The conveyance system conveys the continuous medium along a conveying path. The printing section performs printing on the continuous medium being conveyed along the conveying path. The feed-force adjustment section adjusts feed force to be applied to the continuous medium, the feed-force adjustment section being disposed on a downstream side of the conveying path from the printing section. The feed-force control section controls the feed-force adjustment section so that the feed force to be applied to the continuous medium varies according to a printing condition.

Therefore, because the feed-force control section of the continuous medium printing apparatus of the present invention controls the feed-force adjustment section so that the feed force to be applied to the continuous medium varies according to a printing condition, the continuous medium can be conveyed with an optimum feed force in accordance with the printing condition. With this, even when duplex printing is performed on a continuous medium under a different printing condition, there is no possibility that the tear or slack of the continuous medium or the like will occur and therefore there is an advantage that can enhance printing quality.

The conveyance system may have a pair of conveyor rollers disposed on a downstream side of the conveying path from the printing section so that they are opposite to each other with the continuous medium therebetween, feed force being applied to the continuous medium by rotating the pair of conveyor rollers with the continuous medium clamped therebetween. Also, the feed-force adjustment section may vary the feed force by adjusting pressure of the pair of conveyor rollers with respect to the continuous medium.

The pair of conveyor rollers may be constituted by a scuff roller which conveys the continuous medium in sliding contact with the continuous medium and a pinch roller which clamps the continuous medium in cooperation with the scuff roller, and the feed-force adjustment section may vary the feed force by adjusting pressure of the pinch roller with respect to the scuff roller so that scuff pressure of the scuff roller with respect to the continuous medium is adjusted.

In addition, the conveyance system may have a pair of conveyor rollers disposed on a downstream side of the conveying path from the deflection quantity detection section so that they are opposite to each other with the continuous medium therebetween, feed force being applied to the continuous medium by rotating the pair of conveyor rollers with the continuous medium clamped therebetween, and the feed-force adjustment section varies the feed force by adjusting pressure of the pair of conveyor rollers with respect to the continuous medium.

At this time, the pair of conveyor rollers may be constituted by a scuff roller which conveys the continuous medium in sliding contact with the continuous medium and a pinch roller which clamps the continuous medium in cooperation with the scuff roller, and the feed-force adjustment section may vary the feed force by adjusting pressure of the pinch roller with respect to the scuff roller so that scuff pressure of the scuff roller with respect to the continuous medium is adjusted.

With these arrangements, the construction of the feed-force adjustment section can be simplified and therefore the construction of the printing apparatus can be simplified.

The feed-force adjustment section may be constituted by an arm member which freely rotatably supports the pinch roller and is pivotable on an arm shaft disposed in parallel with a rotating shaft of the pinch roller; a lever member which is pivotable on a lever shaft disposed in parallel with the rotating shaft of the pinch roller; an elastic member for applying the pressure to the pinch roller, the elastic member being interposed between the arm member and the lever member; and a drive mechanism which drives the lever member to rotate on the lever shaft in order to adjust the scuff pressure, by adjusting a rotational angle of the lever member.

Also, the feed-force adjustment section may be constituted by a first arm member which freely rotatably supports the pinch roller and is pivotable on an arm shaft disposed in parallel with a rotating shaft of the pinch roller; a first lever member which is pivotable on a lever shaft disposed in parallel with the rotating shaft of the pinch roller; a first elastic member for applying the pressure, the first elastic member being interposed between the first arm member and the first lever member; and a first drive mechanism which drives the first lever member to rotate on the first lever shaft in order to adjust the scuff pressure, by adjusting a rotational angle of the first lever member.

With these arrangements, the construction of the feed-force adjustment section can be simplified and therefore the construction of the printing apparatus can be simplified.

Note that the printing condition may be a condition including characteristics of the continuous medium. With this, even when duplex printing is performed on a continuous medium having a different printing condition, there is no possibility that the tear or slack of the continuous medium or the like w ill occur and therefore there is an advantage that can enhance printing quality.

In addition, the printing condition may be a print area rate in the continuous medium. Therefore, even when printing is performed up to the vicinity of the perforations formed in the continuous medium, a print trouble area near the perforations can be reduced and therefore there is an advantage that can enhance printing quality.

Furthermore, the printing condition may be the time that the scuff roller has been used. With this, for instance, even when the scuff roller is worn away because of its use, the continuous medium can be conveyed with an optimum feed force in accordance with the printing condition. As a result, there is no possibility that the tear or slack of the continuous medium or the like will occur and there is an advantage that can enhance printing quality.

The aforementioned object of the present invention can also be achieved by a continuous medium printing apparatus for performing printing on both sides of a continuous medium, comprising: a plurality of endless photosensitive bodies for forming images on the continuous medium, the plurality of endless photosensitive bodies being disposed along a conveying path of the continuous medium; and a rotation control section for controlling the plurality of endless photosensitive bodies so that a circumferential velocity of a downstream endless photosensitive body of the plurality of endless photosensitive bodies becomes faster than that of an upstream endless photosensitive body of the plurality of endless photosensitive bodies.

In the continuous medium printing apparatus, therefore, the tension in the continuous medium on the upstream endless photosensitive body can be held so that the perforations in the continuous medium can be stretched. As a result, a print trouble area near the perforations in the continuous medium can be reduced and there is an advantage that can enhance printing quality.

Note that a circumferential velocity of the upstream endless photosensitive body is faster than that of the downstream endless photosensitive body. With this, a print trouble area near the perforations in the continuous medium can be reduced and therefore there is an advantage that can enhance printing quality.

Furthermore, the aforementioned object can be achieved by a continuous medium printing apparatus for performing printing on both sides of a continuous medium, comprising: a plurality of endless photosensitive bodies for forming images on the continuous medium, the plurality of endless photosensitive bodies being disposed along a conveying path of the continuous medium; and an electric potential control section for controlling electric potential of the plurality of endless photosensitive bodies or electric potential of the continuous medium so that an electrostatic adsorption force of the continuous medium with respect to a downstream endless photosensitive body of the plurality of endless photosensitive bodies becomes greater than that of the continuous medium with respect to an upstream endless photosensitive body of the plurality of endless photosensitive bodies.

In the continuous medium printing apparatus, therefore, the tension in the continuous medium on the upstream endless photosensitive body can be held so that the perforations in the continuous medium can be stretched. As a result, a print trouble area near the perforations in the continuous medium can be reduced and there is an advantage that can enhance printing quality.

Note that the potential control section may make the surface potential of the downstream endless photosensitive body greater than that of the upstream endless photosensitive body. With this, the electrostatic adsorption force of the continuous medium with respect to the downstream endless photosensitive body can be greater than that of the continuous medium with respect to the upstream endless photosensitive body. Therefore, the tension in the continuous medium on the upstream endless photosensitive body can be held with reliability so that the perforations in the continuous medium can be stretched. As a result, a print trouble area near the perforations in the continuous medium can be reduced and there is an advantage that can enhance printing quality.

In addition, the potential control section may make the charged potential of the continuous medium on the downstream drum greater than that of the continuous medium on the upstream drum. Similarly, the electrostatic adsorption force of the continuous medium with respect to the downstream drum can be greater than that of the continuous medium with respect to the upstream drum. Therefore, the tension in the continuous medium on the upstream drum can be held with reliability so that the perforations in the continuous medium can be stretched. As a result, a print trouble area near the perforations in the continuous medium can be reduced and there is an advantage that can enhance printing quality.

Note that the potential control section may vary the electrostatic adsorption force in accordance with a printing condition. With this, the continuous medium can be conveyed with an optimum feed force corresponding to the printing condition. Therefore, even when duplex printing is performed on a continuous medium under a different printing condition, there is no possibility that the tear or slack of the continuous medium or the like will occur and there is an advantage that can enhance printing quality.

Moreover, the aforementioned object of the present invention can be achieved by a continuous medium printing apparatus for performing printing on a continuous medium, comprising: a conveyance system for conveying the continuous medium along a conveying path; a printing section for performing printing on the continuous medium being conveyed along the conveying path; and an automatic feed-force adjustment unit for automatically adjusting feed force to be applied to the continuous medium, the automatic feed-force adjustment unit being disposed along the conveying path. The automatic feed-force adjustment unit includes: a buffer section for sucking up deflection of the continuous medium produced due to a change in the feed force to be applied to the continuous medium, the buffer section being disposed on a downstream side of the conveying path from the printing section; a deflection quantity detection section for detecting a quantity of deflection of the continuous medium sucked up by the buffer section, as a quantity corresponding to the feed force to be applied to the continuous medium; a feed-force adjustment section for adjusting the feed force to be applied to the continuous medium, the feed-force adjustment section being disposed on a downstream side of the conveying path from the deflection quantity detection section; and a feed-force control section for controlling the feed-force adjustment section so that the feed force to be applied to the continuous medium varies according to the deflection quantity detected by the deflection quantity detection section.

Thus, in the continuous medium printing apparatus of the present invention, the automatic feed-force adjustment unit includes the buffer section for sucking up deflection of the continuous medium produced due to a change in the feed force to be applied to the continuous medium, the buffer section being disposed on a downstream side of the conveying path from the printing section. Therefore, the continuous medium has no deflection and can be conveyed stably. The automatic feed-force adjustment unit further includes the deflection quantity detection section for detecting a quantity of deflection of the continuous medium sucked up by the buffer section, as a quantity corresponding to the feed force to be applied to the continuous medium; the feed-force adjustment section for adjusting the feed force to be applied to the continuous medium, the feed-force adjustment section being disposed on a downstream side of the conveying path from the deflection quantity detection section; and the feed-force control section for controlling the feed-force adjustment section so that the feed force to be applied to the continuous medium varies according to the deflection quantity detected by the deflection quantity detection section. Therefore, the tension in the continuous medium can be kept constant and there is an advantage that can enhance printing quality.

Note that the buffer section maybe constituted by a buffer roller resting on one side of the continuous medium so as to be movable radially to absorb possible deflection of the continuous medium and so as to be rollable as a follower on the one side surface of the continuous medium in response to the conveyance of the continuous medium; a pair of driven rollers resting on the another side of the continuous medium so as to be rollable as a follower on the another side surface of the continuous medium in response to the conveyance of the continuous medium; and an urging mechanism for urging the butter roller in the direction of deflection in order to apply buffer pressure to the continuous medium in the direction of deflection. With this, the construction of the buffer section can be simplified and therefore the construction of the printing apparatus can be simplified.

The deflection quantity detection section may detect the position of the buffer roller as the quantity of deflection of the continuous medium. With this, the deflection quantity can be detected reliably and therefore there is an advantage that can enhance printing quality.

The continuous medium printing apparatus of the present invention may further include a buffer-pressure adjustment section for adjusting the buffer pressure which is applied to the continuous medium by the buffer roller. With this, even when the printing condition changes due to an exchange of the continuous medium or the like, buffer pressure can be adjusted so that it becomes optimum with respect to a change in the feed force to be applied to the continuous medium. As a result, the deflection of the continuous medium produced due to a change in the feed force can be reliably sucked up and therefore there is an advantage that can enhance printing quality.

In addition, the buffer-pressure adjustment section may be constituted by a second arm member which freely rotatably supports the buffer roller and is pivotable on a second arm shaft disposed in parallel with a rotating shaft of the buffer roller; a second lever member which is pivotable on a second lever shaft disposed in parallel with the rotating shaft of the buffer roller; a second elastic member for applying the buffer pressure, the second elastic member being interposed between the second arm member and the second lever member; and a second drive mechanism which drives the second lever member to rotate on the second lever shaft in order to adjust the buffer pressure, by adjusting a rotational angle of the second lever member. The second arm member, the second lever member, and the second elastic member may constitute the urging mechanism. With this arrangement, the construction of the buffer-pressure adjustment section can be simplified and therefore the construction of the printing apparatus can be simplified.

Furthermore, the deflection quantity detection section may be constituted by a position detection sensor which detects a position of the second arm member as a position of the buffer roller. With this, the position of the buffer roller can easily be detected and therefore the deflection quantity of the continuous medium can be detected easily and reliably. As a result, there is an advantage that can enhance printing quality and apparatus reliability.

The continuous medium printing apparatus of the present invention may further include a buffer-pressure control section which controls the buffer-pressure adjustment section in order to vary the buffer pressure to be applied to the continuous medium. With this, the buffer pressure to be applied to the continuous medium can be controlled. As a result, there is an advantage that can enhance printing quality and apparatus reliability.

The buffer-pressure control section may control the buffer-pressure adjustment section in accordance with a condition including characteristics of the continuous medium. With this, even when duplex printing is performed on a continuous medium having a different printing condition, the deflection of the continuous medium can be sucked up reliably. As a result, the continuous medium has no deflection and there is an advantage that can stably convey the continuous medium.

In addition, the buffer-pressure control section may control the buffer-pressure adjustment section in accordance with an instruction input from the outside. With this, an optimum buffer pressure corresponding to the continuous medium can be set and the deflection of the continuous medium can be sucked up reliably. As a result, the continuous medium has no deflection and there is an advantage that can stably convey the continuous medium.

The position detection sensor may be constituted by a first position detection sensor which detects that the second arm member has reached an upper limit position corresponding to the case where the deflection quantity of the continuous medium has gone to a predetermined upper value and a second position detection sensor which detects that the second arm member has reached a lower limit position corresponding to the case where the deflection quantity of the continuous medium has gone to a predetermined lower value. The feed-force control section may control the feed-force adjustment section so that the scuff pressure is increased when the first position detection sensor detects the second arm member and is decreased when the second position detection sensor detects the second arm member. With this, the continuous medium can be stretched at all times with a constant tension. As a result, there is no possibility that the tear or slack of the continuous medium or the like will occur and there is an advantage that can enhance printing quality.

The feed-force control section may measure a continuous time period of detecting the second arm member by the first position detection sensor or the second position detection sensor and may give an alarm when the continuous detection time period exceeds a predetermined time period. With this, the feed-force control section can detect the state that the continuous medium cannot be tensioned because of the tear of the continuous medium or the like and the state that the tension in the continuous medium cannot be removed because of the conveyance failure of the continuous medium or the like. As a result, there is an advantage that can enhance apparatus reliability and printing quality.

The continuous medium printing apparatus of the present invention may further include an overrun sensor which detects that the deflection quantity of the continuous medium has gone to an overrun state exceeding an allowable value. The feed-force control section may give an alarm when the overrun sensor detects the overrun state. With this, the feed-force control section can detect the state that the continuous medium cannot be tensioned because of the tear of the continuous medium or the like and the state that the tension in the continuous medium cannot be removed because of the conveyance failure of the continuous medium or the like. As a result, there is an advantage that can enhance apparatus reliability and printing quality.

The overrun sensor may detect the overrun state by the position of the second arm member. The overrun sensor may also detect the overrun state by a rotational angle of the second drive mechanism. With this, the overrun state can be detected with reliability. As result, there is an advantage that can enhance apparatus reliability and printing quality.

The continuous medium printing apparatus of the present invention may further comprise a stopper which regulates rotation of the second arm member when the deflection quantity of the continuous medium exceeds an allowable value. With this, it becomes easy to detect the position of the second arm member. In addition, there is no possibility that the second arm member will interfere with other components because of its excessive rotation and therefore there is an advantage that can enhance apparatus reliability.

The buffer roller may be moved to a position where the buffer roller and the continuous medium do not interfere with each other, when the continuous medium is set into the continuous medium printing apparatus. With this, there is no possibility that when the continuous medium is set into the printing apparatus, the continuous medium will interfere with the buffer roller, and the setting of the continuous paper 1 is easy. As a result, there is an advantage that can quickly set the continuous medium into the continuous medium printing apparatus.

The above and many other objects, features and advantages of the present invention will become manifest to those skilled in the art upon making reference to the following detailed description and accompanying drawings in which preferred embodiments incorporating the principle of the present invention are shown by way of illustrative example.

BRIEF DESCRIPTION OF THE DRAWINGS

FIG. 3 is a diagram for describing the relationship between scuff force and a print trouble area in the continuous medium printing apparatus of the first embodiment of the present invention;

FIG. 4 is a diagram for describing the relationship between the circumferential velocity of the photosensitive drum and the print trouble area in the continuous medium printing apparatus of the first embodiment of the present invention;

FIG. 7 is a diagram for describing control voltage that controls transfer current in the continuous medium printing apparatus of the second embodiment;

DESCRIPTION OF THE PREFERRED EMBODIMENTS

Embodiments of the present invention will hereinafter be described with reference to the drawings.

(A) Description of a First Embodiment

A continuous medium printing apparatus as a first embodiment of the present invention (there are cases where it is referred to as simply a continuous paper printing apparatus or a printing apparatus) is connected to a host apparatus such as a host computer and the like. In accordance with a print request from this host apparatus, the continuous medium printing apparatus conveys a continuous medium, such as continuous recording paper, which is an object to be printed (there are cases where it is called continuous paper or a blank form), and performs printing on both sides of the continuous medium by an electrophotographic method.

Figure 1:
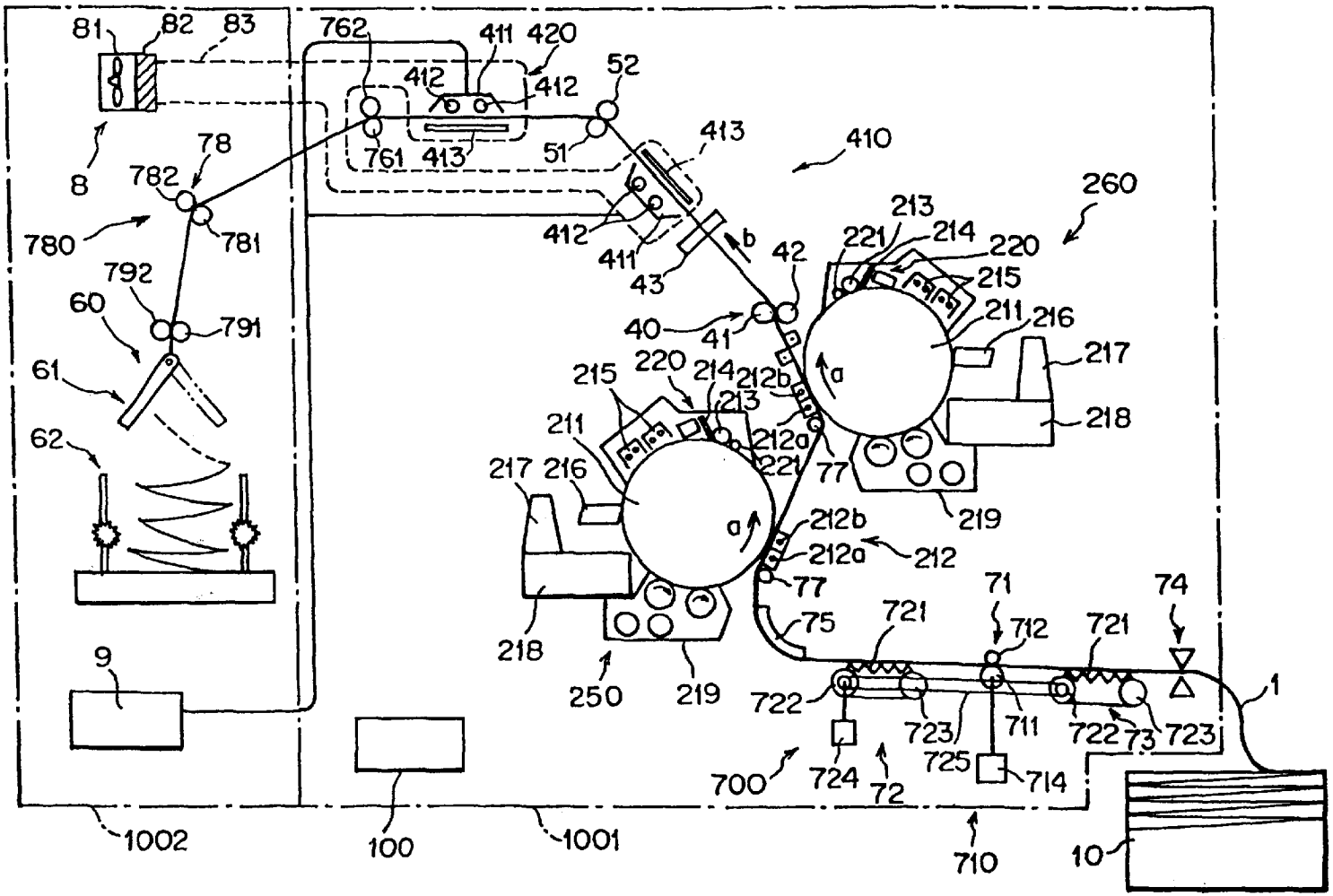
FIG. 1 is a schematic side view showing the construction of a continuous medium printing apparatus as a first embodiment of the present invention.

FIG. 1 schematically illustrates the construction of the continuous medium printing apparatus as the first embodiment of the present invention. The printing apparatus, as shown in the figure, is constituted by a paper hopper 10, a conveyance system 700, a first transferring process unit 250, a second transferring process unit 260, a first fixing section 410, a second fixing section 420, a stacker 60, a blower 8, a control section 100, and a flash-fixer power source 9.

Figure 13:
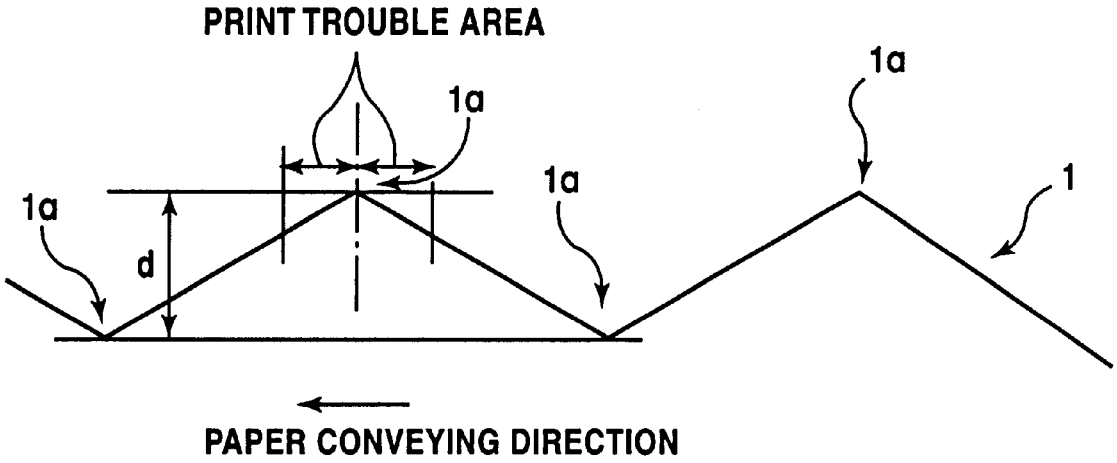
FIG.13 PRIOR ART
FIG. 13 is a side view of stretched continuous paper.

In the continuous paper printing apparatus of the first embodiment, perforations 1*a* (see FIG. 13) are formed at fixed intervals in continuous paper 1 in order to fold and house the continuous paper 1 in the stacker 60 after printing. In the laterally opposite portions of the continuous paper 1, feed holes 1*b* (see FIG. 10) are formed at regular intervals and engage the feed pins of tractor belts 721 forming tractor mechanisms 72, 73 in order to convey the continuous paper 1.

The paper hopper 10 holds unprinted continuous paper 1 in a folded state and serially supplies the continuous paper 1 to the printing apparatus. The operator puts the unprinted continuous paper 1 into this paper hopper 10 before start of printing.

The stacker 60 stacks printed continuous paper 1 being conveyed by the conveyance system 700 in a folded state and is constituted by a swing guide 61 and a stacking section 62.

The first transferring process unit 250 transfers a toner image (image to be printed) to the reverse of the continuous paper 1 under the control of the control section 100 by the electrophotographic method. The first transferring process unit 250 is constituted by a photosensitive drum (a drum, an upstream drum, endless photosensitive body) 211, a transfer section 212, an exposure light-emitting diode (LED) 216, pre-chargers 215, a cleaning section 220, and a toner-hopper-attached developing unit 219. The first transferring process unit 250 is further constituted by components (not shown) such as an AC electricity removing unit, an LED electricity removing unit and the like.

During printing, the photosensitive drum 211 rotates in a direction indicated by an arrow a in FIG. 1 in contact with the continuous paper 1. While photosensitive drum 211 is rotating, a toner image is formed on the outer circumferential surface of the photosensitive drum 211 and the toner image is transferred from the outer circumferential surface on the continuous paper 1.

At the outer circumferential surface of the photosensitive drum 211 and above the photosensitive drum 211, a cleaning section 220 which is a cleaner unit for collecting the exhaust toner or the like on the outer circumferential surface of the photosensitive drum 211 is disposed.

The cleaning section 220, as shown in FIG. 1, is constituted by a constant-pressure blade 214, a cleaning brush 213, and an exhaust toner screw 221.

The constant-pressure blade 214 abuts the outer circumferential surface of the photosensitive drum 211 over the overall length in the axial direction of the photosensitive drum 211 at a predetermined angle. When the photosensitive drum 211 rotates in one direction (direction of arrow a in FIG. 1) in contact with the constant-pressure blade 214, the residual toner adhering to the surface of the photosensitive drum 211 is separated at the contacted portion with the constant-pressure blade 214 from the surface of the photosensitive drum 211.

On an upstream side from the constant-pressure blade 214, the cleaning brush 213 is disposed over the overall length in the axial direction of the photosensitive drum 211 so that it contacts the photosensitive drum 211. In contact with the photosensitive drum 211, the cleaning brush 213 is driven to rotate in the direction opposite to the rotational direction of the photosensitive drum 211 (direction of arrow a). With this rotation, the cleaning brush 213 moves the residual toner, separated from the photosensitive drum 211 by the constant-pressure blade 214, toward the exhaust toner screw 221.

On an upstream side of the outer circumferential surface of the photosensitive drum 211 from the cleaning brush 213, a scraping plate (not shown) for scraping residual toner from the cleaning brush 213 is fixedly provided over the overall length in the axial direction of the photosensitive drum 211 so that it sticks into the cleaning brush 213. In addition, at a position under this scraping plate, the exhaust toner screw 221 is disposed in parallel with the photosensitive drum 211. This exhaust toner screw 221 is driven to rotate in a predetermined direction by means of a drive motor (not shown).

On one side (exhaust toner exhausting side) of the exhaust toner screw 221, a spent toner cartridge 217 is disposed as an exhaust toner collector in order to collect exhaust toner being sent out by the exhaust toner screw 221. That is, the exhaust toner being conveyed by rotation of the exhaust toner screw 221 falls and is collected into the exhaust toner collector.

Note that the above-mentioned cleaning section 220 is enclosed with a cover (not shown), in order to prevent residual toner from falling on the photosensitive drum 211 until it is separated from the photosensitive drum 211 and collected in the exhaust toner collector.

At downstream positions of the outer circumferential surface of the photosensitive drum 211 from the cleaning section 220, a plurality (in this embodiment, two pre-chargers) of pre-chargers 215 are disposed. The surface of the photosensitive drum 211 is evenly charged with electricity by these pre-chargers 215. The charging voltage of each pre-charger 215 is controlled by the control section 100.

At a downstream position of the outer circumferential surface of the photosensitive drum 211 from the pre-chargers 215, the exposure LED 216 is disposed. This exposure LED 216 consists of an LED head and the like and is an optical exposure unit for projecting an optical image, corresponding to an image to be printed, onto the surface of the photosensitive drum 211 to form an electrostatic latent image.

At a downstream position of the outer circumferential surface of the photosensitive drum 211 from the exposure LED 216, the toner-hopper-attached developing unit 219 is disposed. This toner-hopper-attached developing unit 219 develops the electrostatic latent image formed by the exposure LED 216, thereby forming a toner image. A toner hopper 218 for supplying toner for development to the toner-hopper-attached developing unit 219 is attached to the toner-hopper-attached developing unit 219. Furthermore, a toner cartridge 217 for supplying toner for development to the toner hopper 218 is detachably attached to the toner hopper 218.

On a downstream side of the outer circumferential surface of the photosensitive drum 211 from the toner-hopper-attached developing unit 219, the photosensitive drum 211 contacts the continuous paper 1, the toner image on the photosensitive drum 211 being transferred onto the continuous paper 1 by the transfer section 212.

The transfer section 212 is constituted by a transfer charger 212*a* and a separation charger 212*b* and is disposed at a position across the continuous paper 1 from the photosensitive drum 211.

At the contacted position between the photosensitive drum 211 and the continuous paper 1, the transfer charger 212*a* generates corona discharge with the potential of the opposite polarity from the charged potential of the toner image and charges the continuous paper 1 with electricity, thereby attaching and transferring the toner image to the continuous paper 1.

On a downstream side of the conveying path of the continuous paper 1 from the transfer charger 212*a*, the separation charger 212*b* is disposed in proximity to the transfer charger 212*a*, and in order to make it easy to separate the continuous paper 1 from the photosensitive drum 211, the separation charger 212*b* charges the continuous paper 1 with electricity so that the electric charge of the continuous paper 1 after toner image transfer is canceled or removed.

And the charging voltages of the transfer charger 212*a* and the separation charger 212*b* are controlled by the control section 100, respectively.

Note that with the rotation of the drum 211 in the direction of arrow a, the outer circumferential surface of the photosensitive drum 211 passes the position of transferring the toner image to the continuous paper 1 and then passes the cleaning section 220, and in this cleaning section 220, the residual toner on the outer circumferential surface of the photosensitive drum 211 is removed as described supra.

On an upstream side of the conveying path of the continuous paper 1 from the transfer section 212, a transfer guide roller 77 is provided. This transfer guide roller 77 rotates clamping the continuous paper 1 between it and the photosensitive drum 211 and guides the continuous paper 1 in the conveying direction of the continuous paper 1.

And the transfer section 212 and the transfer guide roller 77 are moved toward and away from the photosensitive drum 211 by a moving mechanism (not shown).

The second transferring process unit 260 is disposed above the above-mentioned first transferring process unit 250 and transfers a toner image on the obverse of the continuous paper 1 under the control of the control section 100 by the electrophotographic method. The second transferring process unit 260 has nearly the same construction as the first transferring process unit 250 and is constructed and disposed such that it is nearly symmetrical with the first transferring process unit 250 about a vertical plane.

Note that in the second transferring process unit 260 shown in FIG. 1, the same reference numerals will be applied to the same parts as the aforementioned first transferring process unit 250 and to nearly the same parts for omitting a description thereof. The second transferring process unit 260 is also provided with a moving mechanism of the same construction as the first transferring process unit 250.

The first fixing section 410 and the second fixing section 420 both fix the transferred toner images to the reverse and obverse of the continuous paper 1. In the first embodiment the fixing sections 410, 420 employ flash fixers and have similar construction. That is, the fixing sections 410, 420 are each provided with flash lamps 412, a reflecting mirror 411, and a counter reflecting mirror 413.

The flash lamp 412 emits flashlight for fixing a toner image to the continuous paper 1 and employs, for example, a xenon lamp. The reflecting mirror 411 is disposed behind the flash lamps 412 so that the flashlight from the flash lamps 412 is reflected to the fixing side (toner image) of the continuous paper 1. The counter reflecting plate 413 is disposed at a position across the continuous paper 1 from the flash lamps 412 and the reflecting mirror 411 in order to direct the flashlight from the flash lamp 412 efficiently to the continuous paper 1.

The first fixing section 410 is disposed on a downstream side from the first transferring process unit 250 to fix the toner image transferred to the reverse of the continuous paper 1 by the first transferring process unit 250. The second fixing section 420 is disposed on a downstream side from the first transferring process unit 260 to fix the toner image transferred to the obverse of the continuous paper 1 by the second transferring process unit 260. Note that in the first embodiment, the second fixing section 420 is disposed on a downstream side from the first fixing section 410.

The first fixing section 410 and the second fixing section 420 are enclosed with a duct 83. This duct 83 is connected to the blower 8 to collect smoke, an offensive smell and the like (consisting of organic high molecular compounds such as styrene, butadiene, phenol and the like), produced in the first fixing section 410 and the fixing section 420.

The blower 8 is constituted by a fan 81 and a filter 82 which consists of active carbon and the like. The fan 81 exhausts air within the duct 83. With this, smoke and the like produced in the first and second fixing sections 410, 420 are collected through the duct 83. After offensive smell and the like have been adsorbed by the filter 82, they are exhausted outside the apparatus of the first embodiment through the fan 81.

In the first embodiment, the first transferring process unit 250, the second transferring process unit 260, the first fixing sections 410, and the second fixing sections 420 perform printing on the continuous paper 1 being conveyed along the conveying path. Thus, the first transferring process unit 250, the second transferring process unit 260, the first fixing sections 410, and the second fixing sections 420 function as a printing section.

The conveyance system 700 is used for conveying the continuous paper 1 from the paper hopper 10 to the stacker 60 along the conveying path. With this conveyance system 700, the continuous paper 1 is sent out from the paper hopper 10 and is conveyed along the conveying path in the order of first transferring process unit 250, second transferring process unit 260, first fixing section 410, and second fixing section 420. After printing has been performed on the continuous paper 1, it is sent out to the stacker 60.

Here, the conveyance system 700 is constituted by a conveyor tractor 710, a guide section 75, guide rollers 77, turn rollers 41, 42, 51, 52, an exhaust roller 761, a scuff roller 791, pinch rollers 762, 792, and a conveyor roller pair 78.

The conveyor tractor 710 is a conveyor unit for conveying the continuous paper 1 and constituted by a plurality (in this embodiment, two) of tractor mechanisms 72, 73. These tractor mechanisms 72, 73 have the same construction. Each tractor mechanism is constructed such that an endless tractor belt 721 is looped between a driving shaft 722 and a driven shaft 723 disposed in parallel with each other. The endless tractor belt 721 has feed pins projecting from the laterally opposite ends thereof at regular intervals so that the feed pins are engageable with the feed holes 1*b* formed in the laterally opposite ends of the continuous paper 1.

Between the driving shaft 722 of the downstream tractor mechanism 72 and the driving shaft 722 of the upstream tractor mechanism 73, a driving belt 725 is looped. Furthermore, the driving shaft 722 of the downstream tractor mechanism 72 is connected to a driving motor 724. This driving motor 724 is capable of driving the driving shaft 722 of the downstream tractor mechanism 72 to rotate at an arbitrary speed in an arbitrary direction. If the driving shaft 722 of the downstream tractor mechanism 72 is driven to rotate by the driving motor 724, the driving force is also transmitted to the driving shaft 722 of the upstream tractor mechanism 72 through the driving belt 725 and therefore the downstream tractor belt 721 in the downstream tractor mechanism 72 and the upstream tractor belt 721 in the upstream tractor mechanism 73 are driven to rotate in the same direction in synchronization with each other, whereby the continuous paper 1 can be conveyed in both the printing-time conveying direction (indicated by an arrow b in FIG. 1) and the opposite direction from the conveying direction.

Between the upstream tractor mechanism 73 and the downstream tractor mechanism 72 (i.e., on an upstream side from the downstream tractor mechanism 72), the conveyor tractor 710 is further provided with a back tension roller 71 for producing tension in the opposite direction from the printing-time conveying direction of the continuous paper 1. This back tension roller 71 is constituted by a pair of pressure rollers: a driving pressure roller 711 and a driven pressure roller 712.

The driving pressure roller 711 is connected to a driving motor 714. With this driving motor 714, the driving pressure roller 711 is driven to rotate at an arbitrary speed in both the printing-time conveying direction of the continuous paper 1 and the opposite direction from the conveying direction.

The driven pressure roller 712 presses the obverse of continuous paper 1 downwardly against the driving pressure roller 711 and rotates as a follower in response to the conveyance of the continuous paper 1.

More specifically, the back tension roller 71 applies tension to the driving pressure roller 711 in the opposite direction from the printing-time conveying direction of the continuous paper 1 with the continuous paper 1 clamped between the driving pressure roller 711 and the driven pressure roller 712. With this, tension is applied to the continuous paper 1 in the opposite direction from the printing-time conveying direction of the continuous paper 1, and consequently, the continuous paper 1 can be stretched.

The guide section 75 is provided so that the continuous paper 1 being sent out from the conveyor tractor 710 is guided upward in a vertical direction along the conveying direction. This guide section 75 is constituted by a curved plate member.

As described supra, the transfer guide rollers 77 are provided in the transferring process units 250, 260, respectively and each guide roller 77 rotates clamping the continuous paper 1 between it and the photosensitive drum 211, thereby guiding this continuous paper 1 in the printing-time conveying direction.

Note that turn rollers 41 and 42 to be described infra and the transfer guide roller 77 are charged with electricity to the same polarity as the unfixed toner on the continuous paper 1, respectively. With this, there is no possibility that the unfixed toner on the continuous paper 1 will adhere to the turn rollers 41, 42 and the transfer guide roller 77 and that the toner image formed on the continuous paper 1 will be disturbed, when the turn rollers 41, 42 and the transfer guide roller 77 contact the unfixed toner on the continuous paper 1. Also, the turn rollers 41, 42 and the transfer guide roller 77 rotate only in the printing-time conveying direction.

Between the second transferring process unit 260 and the first fixing section 410, the turn rollers 41 and 42 are disposed opposite to each other with the continuous paper 1 therebetween so that they contact the reverse and obverse of the continuous paper 1, respectively. The turn rollers 41, 42 form the turn roller pair 40. These turn rollers 41, 42 are connected to drive motors (not shown), respectively and the rollers 41, 42 are driven to rotate by the drive motors.

Here, the continuous paper 1 is wound by a predetermined angle around the turn roller 41, whereby the conveying direction of the continuous paper 1 is turned so that the angle between the conveying direction of the continuous paper 1 in the second transferring process unit 260 and the conveying direction of the continuous paper 1 in the first fixing section 410 becomes a predetermined angle or beyond. The turn rollers 41, 42 function as a light intercepting member for preventing the light leaking from the first fixing section 410 and the second fixing section 420 from reaching the first transferring process unit 250 and the second transferring process unit 260. Note that between the second transferring process unit 260 and the first fixing section 410, a light intercepting section 43 for intercepting the light leaking from the first fixing section 410 is disposed.

As described supra, the turn rollers 41, 42 turn the conveying direction of the continuous paper 1 and also function as a light intercepting member. Therefore, the turn rollers 41, 42 can prevent the light leaking from the first fixing section 410 and the second fixing section 420 from reaching the photosensitive drums 211 of the first and second transferring process units 250, 260 and prevent a reduction in the service life of each photosensitive drum 211 due to light degradation. Furthermore, the turn rollers 41, 42 can prevent a reduction in printing quality due to a reduction in the surface potential of the photosensitive drum 211.

As described supra, these turn rollers 41, 42 and the transfer guide roller 77 are constructed so that they rotate only in the printing-time conveying direction, and the rotations of the turn rollers 41, 42 and the transfer guide roller 77 are controlled by the control section 100, respectively. The turn rollers 41 and 42 are disposed opposite to each other with the continuous paper 1 therebetween so that they contact the reverse and obverse of the continuous paper 1, respectively. The continuous paper 1 is wound by a predetermined angle around the second turn roller 51, whereby the conveying direction of the continuous paper 1 is turned so that the angle between the conveying direction of the continuous paper 1 in the first fixing section 410 and the conveying direction of the continuous paper 1 in the second fixing section 420 becomes a predetermined angle or beyond. The pinch roller 52 presses the obverse of the continuous paper 1 downwardly against the second turn roller 51 and rotates as a follower in response to the conveyance of the continuous paper 1. The second turn roller 51 is connected to a drive motor (not shown) and driven to rotate by this drive motor.

In addition, frictional force is produced between the surface of the continuous paper 1 and the roller surface of the second turn roller 51 by winding the continuous paper 1 on the second turn roller 51 by a predetermined angle, and acts as reaction force on the continuous paper 1 when the continuous paper 1 is conveyed by the conveyor tractor 710. Thus, the second turn roller 51 is capable of stretching the continuous paper 1 at all times during conveyance.

Note that in the first embodiment, although the second turn roller 51 abuts the reverse of the continuous paper 1, there is no possibility that the second turn roller 51 will disturb the toner image on the reverse of the continuous paper 1 and reduce the printing quality of the continuous paper 1, because the toner image on the reverse of the continuous paper 1 has already been fixed by the first fixing section 410.

In addition, since the second turn roller 51 changes the conveying direction of the continuous paper 1 so that the conveying direction of the continuous paper 1 in the second fixing section 420 is approximately horizontal, the second fixing section 420 can be disposed at a lower position. As a result, the height of the conveying path of the continuous paper 1 can be lowered, whereby the size of the apparatus can be reduced.

Moreover, the change in the conveying direction of the continuous paper by the second turn roller 51 can also prevent the light leaking from the second fixing section 420 from reaching each photosensitive drum 211 of the first and second transferring process units 250, 260. Furthermore, the second turn roller 51 prevents the light leaking from the second fixing section 420 from propagating along the obverse of the continuous paper 1 and then reaching the second transferring process unit 260. Thus, the second turn roller 51 also fulfils the function of intercepting the light leaking from the second fixing section 420.

On a downstream side from the second fixing section 420, the exhaust roller 761 and the pinch roller 762 are disposed opposite to each other with the continuous paper 1 therebetween so that they contact the reverse and obverse of the continuous paper 1, respectively. The continuous paper 1 is wound on the exhaust roller 761 by a predetermined angle, whereby the conveying direction of the continuous paper 1 is changed from the horizontal direction to the downward direction. The pinch roller 762 presses the obverse of the continuous paper 1 downwardly against the second turn roller 51 and rotates as a follower in response to the conveyance of the continuous paper 1. The exhaust roller 761 is connected to a drive motor (not shown) and driven to rotate by this drive motor.

Figure 2:
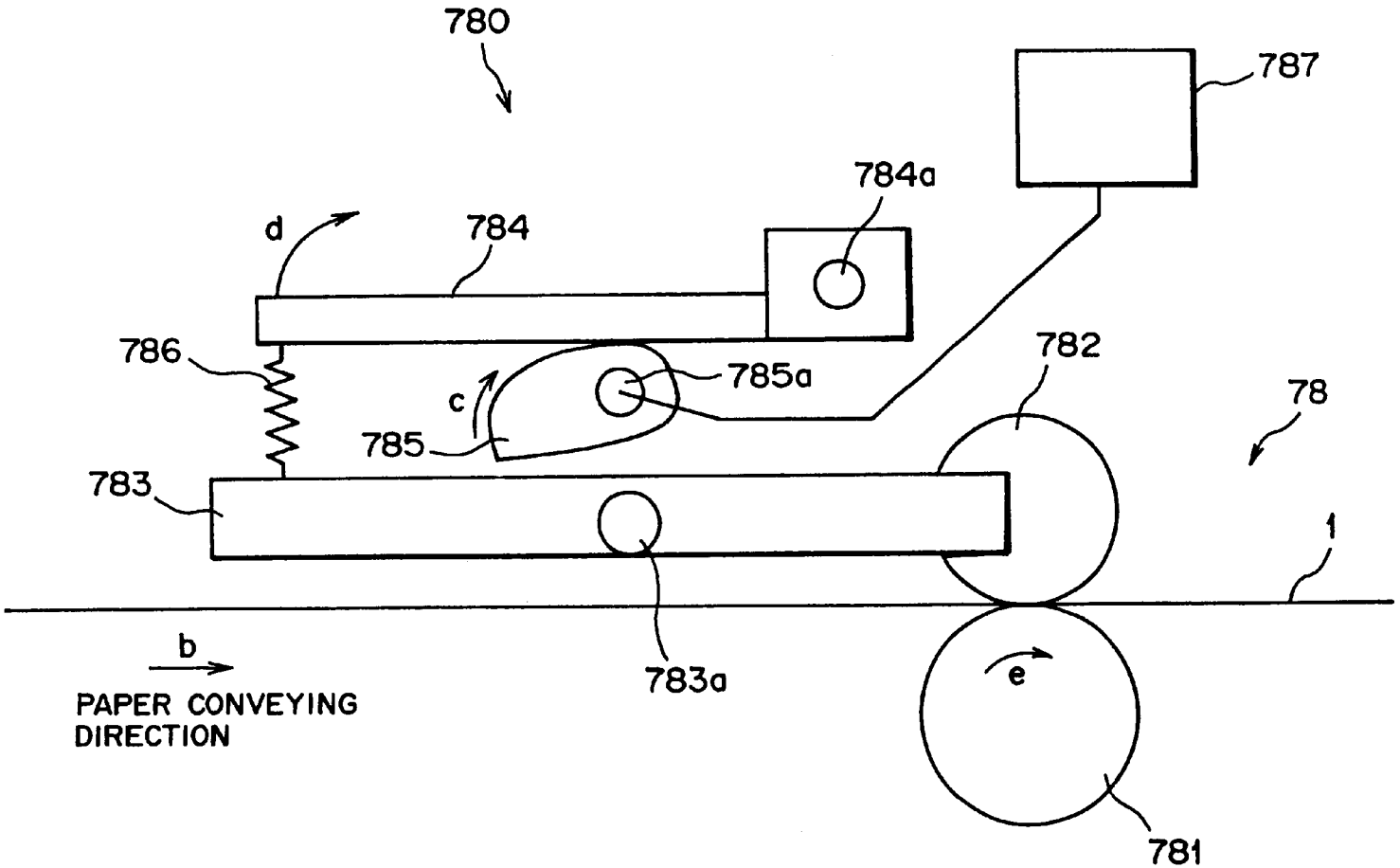
FIG. 2 is a schematic side view showing the construction of the conveyor roller pair and feed-force adjustment section in the continuous medium printing apparatus of the first embodiment of the present invention.

FIG. 2 schematically illustrates the construction of the conveyor roller pair 78 and feed-force adjustment section 780 in the continuous medium printing apparatus of the first embodiment of the present invention. The conveyor roller pair 78, as shown in the figure, is constituted by a scuff roller 781 and a pinch roller 782.

The scuff roller 781 conveys the continuous paper 1 in sliding contact with the continuous paper 1 and has an outer circumferential surface constituted by material whose coefficient of friction is low, such as metal. This scuff roller 781 is driven to rotate in the printing-time conveying direction (the direction of arrow e in FIG. 2) by a drive motor (not shown), the rotational speed ($V_s$) being controlled by a control section 100 to be described infra.

The pinch roller 782 clamps the continuous paper 1 in cooperation with the scuff roller 781 and is disposed in parallel with the scuff roller 781. The pinch roller 782 is freely rotatably clamped by one end (in FIG. 2, the right end) of each of a pair of arm members 783, 783. Each arm member 783 is rotatably supported at its intermediate end portion by an arm shaft 783*a*. Note that it is preferable that the pinch roller 782 be constituted by resin having no elasticity, such as polyoxymethylene (POM).

The conveyor roller pair 78 is disposed at a downstream position of the conveying path of the continuous paper 1 from the exhaust roller 761 and the pinch roller 762, as shown in FIG. 1. The scuff roller 781 and pinch roller 782 of the conveyor roller pair 78 are disposed opposite to each other with the continuous paper 1 therebetween so that they contact the reverse and obverse of the continuous paper 1, respectively.

Therefore, in the printing apparatus of the present invention, the conveyor roller pair 78 is disposed on a downstream side of the conveying path of the continuous paper 1 from the printing section so that the scuff roller 781 and pinch roller 782 of the conveyor roller pair 78 are opposite to each other with the continuous paper 1 therebetween, and the conveyor roller pair 78 rotates clamping the continuous paper 1, thereby applying feed force to the continuous paper 1.

The feed-force adjustment section 780 varies feed force to be applied to the continuous paper 1, by adjusting the pressure of the pinch roller 782 with respect to the scuff roller 781 so that the scuff pressure of the scuff roller 781 with respect to the continuous paper 1 is adjusted. As shown in FIG. 2, the feed-force adjustment section 780 is provided on the laterally opposite sides of the continuous paper 1 (or the pinch roller 782) with a pair of right and left arm members 783, a pair of right and left lever members 784, and a pair of right and left cams 785.

The pair of right and left arm members 783 are disposed in parallel with each other and freely rotatably support the pinch roller 782 at one end (in FIG. 2 the right end) of each arm member 783. The intermediate portion of each arm member 783 is supported on the arm shaft 783*a* parallel with the rotating shaft of the pinch roller 782 so that each arm member 783 is pivotable on this arm shaft 783*a*.

The pair of right and left lever members 784 are disposed in parallel with each other above the arm members 783, respectively. One end (in FIG. 2, the right end) of each lever member 784 is supported on a lever shaft 784*a* parallel with the rotating shaft of the pinch roller 782 so that each lever member 784 is pivotable on the lever shaft 784*a*.

At a position below each lever member 784, the cam 785 is rotatably supported on a camshaft 785*a* so that it abuts the lower surface of each lever member 784. This camshaft 785*a* is connected to a drive motor 787. This drive motor 787 is capable of rotating the camshaft 785*a* of the cam 785 to a predetermined angle under control by the control section 100 to be described infra.

The drive motor 787 functions as a drive mechanism for driving the lever members 784, 784 to both pivot on the lever shaft 784*a* in order to adjust scuff pressure, by adjusting the pivot angles of the lever members 784, 784. The drive motor 787 rotates the camshaft 785*a*, thereby adjusting the angle of the cams 785, 785.

And these cams 785, 785 pivot contacting the lower surfaces of the lever members 784, 784, thereby pivoting the lever members 784,784 on the lever shaft 784*a*. As a result, the position of one end (in FIG. 2 the left end) of each lever member 784 is varied, whereby the angle of the lever members 784 and 784 with respect to the lever shaft 784*a* is adjusted.

Between the other end (in FIG. 2 the left end) of one arm member 783 and the other end (in FIG. 2, the left end) of one lever member 784 and between the other end of the other arm member 783 and the other end of the lever member 784, springs (elastic members) 786 are interposed respectively so that the pressure of the pinch rollers 782 is applied to the scuff roller 781.

That is, the arm members 783, 783 are rotated on the arm shaft 783*a* through the springs 786, 786 in accordance with movement of one end (in FIG. 2 the left end) of each lever member 784, whereby the position of one end (in FIG. 2 the left end) of each arm member 783 is moved up and down. With this, the arm member 783 varies the position of the other end (in FIG. 2 the right end), that is, the position of the pinch roller 782, thereby adjusting the pressure of the pinch roller 782 with respect to the scuff roller 781 so that the scuff pressure of the scuff roller 781 with respect to the continuous paper 1 is adjusted.

For instance, the control section 100 pivots the lever members 784, 784 on the lever shaft 784*a* in the direction of arrow d, by driving the cams 785, 785 to rotate in the direction of arrow c by the drive motor 787. This causes one end (the left end in FIG. 2) of each arm member 783 to move upward through the springs 786, 786. With this, the pinch roller 782 is pressed against the scuff roller 781 and therefore scuff pressure is increased.

In addition, the continuous paper printing apparatus of the first embodiment is constituted by two sections, a first case 1001 and a second case 1002, as shown in FIG. 1. Within the first case 1001, the first transferring process unit 250, the second transferring process unit 260, the first fixing section 410, the second fixing section 420, the conveyance system 700, and the control section 100 are disposed. A main power source, which supplies power to the first transferring process unit 250, the second transferring process unit 260, the conveyance system 700 and the like, are also disposed within the first case 1001. Within the second case 1002, the blower 8, the stacker 60, and the flash-fixer power source 9 are disposed. The scuff rollers 781, 791 and pinch rollers 782, 792 forming part of the conveyance system 700 are also disposed within the second case 1002.

That is, in the apparatus of the present invention, the stacker 60 is disposed on a downstream side of the conveying path from the second fixing section 420 and also within a range of a conveying path length where data compensation is possible with the host computer that is a host apparatus making a print request. When a problem such as a jam of the continuous paper 1 arises because the conveying path length of the continuous paper 1 from the second fixing section 420 to the stacker 60 is short, the reprinting of the portion of the continuous paper 1 where the problem has arisen can be performed quickly by the host computer. As a result, the time required for recovery operation can be shortened and apparatus reliability can be enhanced.

Note that the flash-fixer power source 9 is used for supplying power to the first fixing section 410, the second fixing section 420, and the flash lamps 412.

The conveyor tractor 710 is provided on an upstream side of the conveying path from the upstream tractor mechanism 73 with a last-end detection section 74 which detects the last end portion of the continuous paper 1. This last-end detection section 74 is constituted, for example, by an optical sensor consisting of a light-emitting element and a light-receiving element. The continuous paper 1 is disposed so that it intercepts the optical path between the light-emitting and light-receiving elements. When the continuous paper 1 intercepting the optical path between the light-emitting and light-receiving elements has gone, light from the light-emitting element is detected by the light-receiving element. The result of detection is displayed on a display section or the like (not shown), whereby the operator is informed that the last end of the continuous paper 1 has been detected.

In addition, the components in the printing apparatus of the first embodiment, i.e., the paper hopper 10, the conveyance system 700, the first transferring process unit 250, the second transferring process unit 260, the first fixing section 410, the second fixing section 420, the stacker 60, the blower 8, the flash-fixer power source 9 and the like are controlled by the control section 100.

Furthermore, the control section 100 performs control, based on information input from a control panel (not shown). The control panel is attached to the side or the like of the printing apparatus main body of the first embodiment and is operated by the operator in order to perform input or setting with respect to the continuous paper printing apparatus. This control panel has a display (not shown) for displaying various states of the continuous medium printing apparatus.

The operator inputs paper conditions, such as the paper basis weight (paper thickness), paper width (paper size), paper stem, paper surface smoothness and the like of the continuous paper 1, as printing conditions.

The control section 100 controls the rotation of the drive motor 787 of the feed-force adjustment section 780, as described supra and therefore functions as a feed-force control section which controls the feed-force adjustment section 780 so that the feed force to be applied to the continuous paper 1 varies according to information (printing conditions) input from the control panel.

More specifically, the control section 100 previously has control values for the drive motor 787 (pulse information for stopping the motor shaft at a predetermined position) corresponding to various paper conditions for the continuous paper 1 (paper basis weight (paper thickness), paper width, paper stem, paper surface smoothness, etc.) as a table, and obtains a control value corresponding to a printing condition input by the control panel, from this table and then drives the drive motor 787.

The control section 100 also measures the accumulated rotation time period of the drive motor (not shown) for driving the scuff roller 781, that is, the time that the scuff roller 781 has been used, and therefore serves as a feed-force control section which controls the feed-force adjustment section 780 so that the feed force to be applied to the continuous paper 1 varies according to the time that the scuff controller 781 has been used.

More specifically, the control section 100 previously has control values for the drive motor 787 (pulse information for stopping the motor shaft at a predetermined position) corresponding to the used time of the scuff roller 781 as a table, and obtains a control value corresponding to the used time of the scuff roller 781 from this table and then drives the drive motor 787.

And the control section 100 rotates both the cams 785, 785 on the camshaft 785*a* by a predetermined angle by the drive motor 787. With this, the scuff pressure, produced by the scuff roller 781 and the pinch roller 782, is adjusted so that the feed force to be applied to the continuous paper 1 varies according to the printing conditions for the continuous paper 1.

In addition, the control section 100 controls rotations of the drive motors (not shown) that rotate each photosensitive drum 211 of the first transferring process unit 250 and the second transferring process unit 260, respectively. With this, the control section 100 controls the circumferential velocity of the upstream photosensitive drum 211 of the first transferring process unit 250 and the circumferential velocity of the downstream photosensitive drum 211 of the second transferring process unit 260, respectively.

And the control section 100 controls the rotation of the upstream photosensitive drum 211 of the first transferring process unit 250 and the rotation of the downstream photosensitive drum 211 of the second transferring process unit 260 so that, during duplex printing, the circumferential velocity ($V_2$) of the downstream photosensitive drum 211 becomes faster than the circumferential velocity ($V_1$) of the upstream photosensitive drum 211 and slower than the circumferential velocity ($V_s$) of the scuff roller 781, and therefore functions as a rotation control section. Simultaneously, the control section 100 further controls the rotations of the upstream and downstream photosensitive drums 211, 211 such that the difference therebetween is, for example, of the order of 0.1 to 0.3%.

Furthermore, the control section 100 controls the feed-force adjustment section 780 so that the feed force to be applied to the continuous paper 1 varies according to a printing area rate in the continuous paper 1. More specifically, the control section 100 obtains a printing area rate (i.e., an area ratio of a toner image to the paper area) from a print request made by the host computer, and then controls the feed-force adjustment section 780 so that the feed force becomes greater when the printing area rate is high and less when the printing area rate is low.

When duplex printing is performed on the continuous paper 1 by the continuous medium printing apparatus of the first embodiment constituted as described supra, the operator first sets the continuous paper 1 into the paper hopper 10 and then attaches the continuous paper 1 to the tractor belt 721 of the tractor mechanism 73 by inserting the feed holes 1*b* formed in the laterally opposite portions of the continuous paper 1 onto the feed pins of the tractor belt 721.

And the operator inputs the paper conditions for the continuous paper 1 (paper basis weight (paper thickness), paper width (paper size), paper stem, paper surface smoothness, etc.) from the control panel and then depresses the auto-loading start switch of an auto-loading control panel (not shown) or the like, thereby automatically loading the continuous paper 1. The continuous paper 1 is conveyed to the stacker 60 along the conveying path of the conveyance system 700 by employing conveyance force produced by the conveyor tractor 710, the turn rollers 41, 42 and the like.

Thereafter, print data is sent from the host computer or the like to the printing apparatus of the first embodiment and then duplex printing is started.

In performing duplex printing, the control section 100 first obtains a control value for the drive motor 787 corresponding to the paper condition input from the control panel, from the above-mentioned table and then drives the drive motor 787, based on the control value. That is, the control section 100 rotates the camshaft 784*a* by a predetermined angle by the drive motor 787, thereby adjusting the angle of the cam 785. With the angle adjustment, the angle of the lever members 784, 784 with respect to the lever shaft 784*a* is adjusted. With this, the pressure of the pinch roller 782 toward the scuff roller 781 is adjusted so that the scuff pressure of the scuff roller 781 with respect to the continuous paper 1 is adjusted. With this, the conveyance system 700 is capable of conveying the continuous paper 1 with a feed force optimum to the paper conditions for the continuous paper 1.

And the continuous paper 1 is conveyed in the printing-time conveying direction (the direction of arrow b in FIG. 1) by the conveyance system 700, that is, the conveyor tractor 710, the conveyor roller pair 78 and the like. First, in the first transferring process unit 250, the photosensitive drum 211 is driven to rotate by the drive unit (not shown) in synchronization with the conveyance of the continuous paper 1 performed by the conveyance system 700 and rotates in a direction of arrow a in FIG. 1.

The control section 100 controls rotations of the upstream photosensitive drum 211 of the first transferring process unit 250 and the downstream photosensitive drum 211 of the second transferring process unit 260 so that the circumferential velocity ($V_2$) of the downstream photosensitive drum 211 becomes faster than the circumferential velocity ($V_1$) of the upstream photosensitive drum 211 and slower than the circumferential velocity ($V_s$) of the scuff roller 781. At this time, the circumferential velocity difference is, for example, of the order of 0.1 to 0.3%.

With this, in the first transferring process unit 250, the tension in the continuous paper 1 is held and the perforations 1*a* (see FIG. 13) in the continuous paper 1 are stretched. Therefore, the mountain and the valley (or unevenness) of the continuous paper 1 with the perforations 1*a* as apices become smaller and the gap between the photosensitive drum 211, which transfers a toner image to the continuous paper 1, and the continuous paper 1 becomes smaller.

In the first transferring process unit 250, the surface of the photosensitive drum 211 is evenly charged with electricity by the pre-chargers 215. Thereafter, the exposure LED 216 performs image exposure in accordance with an image signal to be printed on the outer circumferential surface of the photosensitive drum 211, thereby forming a latent image.

And the toner-hopper-attached developing unit 219 develops the latent image, thereby forming a toner image corresponding to the print data onto the outer circumferential surface of the photosensitive drum 211.

At the position where the photosensitive drum 211 abuts the continuous paper 1 and at the position across the continuous paper 1 from the photosensitive drum 211, the transfer charger 212*a* charges the continuous paper 1 with electricity to the polarity opposite from the polarity of the toner forming the toner image. With this, the toner image on the photosensitive drum 211 is attracted to the continuous paper 1 and transferred on the reverse of the medium as the unfixed toner image. After this transfer, the separation charger 212*b* removes the charge in the continuous paper 1 so that the continuous paper 1 can easily be separated from the photosensitive drum 211.

On the other hand, the photosensitive drum 211, which has transferred the toner image to the reverse of the continuous paper 1, is again charged evenly with electricity by the pre-chargers 215, after the residual toner on the surface has been removed by the cleaning section 220.

Next, the continuous paper 1 is conveyed to the second transferring process unit 260 by the conveyance system 700. In this second transferring process unit 260, as with the first transferring process unit 250, the unfixed toner image is transferred to the obverse of the continuous paper 1.

Similarly, in the second transferring process unit 260, the tension in the continuous paper 1 is held and the perforations 1*a* (see FIG. 13) in the continuous paper 1 are stretched. Therefore, the mountain and the valley (or unevenness) of the continuous paper 1 with the perforations 1*a* as apices become smaller and the gap between the photosensitive drum 211, which transfers a toner image to the continuous paper 1, and the continuous paper 1 becomes smaller.

And the continuous paper 1 with the unfixed toner images respectively transferred to both sides thereof is conveyed by the conveyance system 700. After the continuous paper 1 has passed the first turn roller pair 40 and the light intercepting section 43, the toner image transferred to the reverse of the continuous paper 1 is fixed by the first fixing section 410.

The continuous paper 1 is further conveyed by the conveyance system 700 and the conveying direction is turned by the second turn roller 51. In the second fixing section 420 the toner image transferred to the obverse of the continuous paper 1 is fixed.

Furthermore, the continuous paper 1 is conveyed by the conveyance system 700, while it is being guided by the exhaust roller 761 and the pinch roller 762. The continuous paper 1 passes the conveyor roller pair 78 and is guided to the stacker 60 by the scuff roller 791 and the pinch roller 792. And in the stacker 60, the continuous paper 1 is swung by the swing guide 61. With this, the mountain folds and valley folds of the continuous paper 1 are alternately repeated at the perforations 1*a*, and the continuous paper 1 is stacked in an alternately folded state in the stacker section 62.

According to the continuous medium printing apparatus as the first embodiment of the present invention, as described supra, the control section 100 controls the rotation of the drive motor 787 of the feed-force adjustment section 780 so that the feed force to be applied to the continuous paper 1 varies according to the information (printing conditions) input from the control panel. That is, the cam 785 is rotated on the camshaft 785*a* by a predetermined angle by the drive motor 787. With this, the pressure of the pinch roller 782 toward the scuff roller 781 is adjusted so that the scuff pressure of the scuff roller 781 with respect to the continuous paper 1 is varied according to the printing conditions for the continuous paper 1. Therefore, the conveyance system 700 is capable of conveying the continuous paper 1 with a feed force optimum to the paper conditions for the continuous paper 1.

With this, for example, there is no possibility that because feed force is too strong, the continuous paper 1 will tear or that because feed force is too weak, the continuous paper 1 will slacken and printing quality will be reduced.

In addition, the control section 100 controls the rotation of the upstream photosensitive drum 211 of the first transferring process unit 250 and the rotation of the downstream photosensitive drum 211 of the second transferring process unit 260 so that the circumferential velocity ($V_2$) of the downstream photosensitive drum 211 becomes faster than the circumferential velocity ($V_1$) of the upstream photosensitive drum 211 and slower than the circumferential velocity ($V_s$) of the scuff roller 781. Simultaneously, the control section 100 controls the rotations of the upstream and downstream photosensitive rollers 211, 211 such that the difference therebetween is, for example, of the order of 0.1 to 0.3%. With this, the feed force in the conveyor roller pair 78, disposed at a downstream position of the conveying path of the continuous paper 1 from the second transferring process unit 260, can be transmitted to the first transferring process unit 250 and the second transferring process unit 260, whereby the tension in the continuous paper 1 can also be held in the first transferring process unit 250 disposed at a position away from the conveyor roller pair 78.

In the first transferring process unit 250, therefore, the perforations 1*a* (see FIG. 13) in the continuous paper 1 are stretched. Therefore, the mountain and the valley (or unevenness) of the continuous paper 1 with the perforations 1*a* as apices become smaller and the gap between the photosensitive drum 211, which transfers a toner image to the continuous paper 1, and the continuous paper 1 becomes smaller. As a result, print trouble, such as a shear in printing, an omission of printing and the like, or the occurrence of unevenness, near the perforations 1*a* can be suppressed to the minimum.

In addition, there is no need to dispose special components, such as conveyor tractors, between the first transferring process unit 250 and the second transferring process unit 260, so there is no possibility that the size of the apparatus will be increased.

Furthermore, because the control section 100 controls the feed-force adjustment section 780 so that the feed force to be applied to the continuous paper 1 varies according to a printing area rate in the continuous paper 1, a print trouble area near the perforations 1*a* can be reduced and printing quality can be enhanced, even when printing is performed up to the vicinity of the perforations 1*a* formed in the continuous paper 1.

FIG. 3 shows the relationship between scuff force and a print trouble area in the continuous medium printing apparatus of the first embodiment of the present invention; FIG. 4 shows the relationship between the circumferential velocity of the photosensitive drum 211 and the print trouble area.

FIG. 3 shows the size of each print trouble area in the case where duplex printing is performed by conveying the continuous paper 1 having a different paper condition (a different paper basis weight) with a different scuff force. That is, duplex printing is performed by conveying the continuous paper 1 having a basis weight of 55 kg/M$^3$ and the continuous paper 1 having a basis weight of 135 kg/M$^3$ with three kinds of scuff forces (20, 35, and 50 g/cm), respectively, and print trouble areas on the surface (printed by the second transferring process unit 260) are represented by distances from the perforations 1*a*, respectively.

As shown in FIG. 3, for example, in the case of the continuous paper 1 with a basis weight of 135 kg/m$^3$, the print trouble area becomes smaller when scuff force is 50 g/cm, and can be made smaller by increasing scuff force. It has been found that the effect is conspicuous particularly in the continuous paper 1 with a greater basis weight.

FIG. 4 shows that, when duplex printing has been performed by varying the circumferential velocity difference (circumferential velocity ratio) between the circumferential velocity ($V_1$) of the upstream photosensitive drum 211 of the first transferring process unit 250 and the circumferential velocity ($V_2$) of the downstream photosensitive drum 211 of the second transferring process unit 260 (in a range of +2.0 to −0.2%), the print trouble areas are presented by distances from the perforations 1*a*.

Note that the circumferential velocity ratio is represented as + when the circumferential velocity ($V_2$) of the downstream photosensitive drum 211 of the second transferring process unit 260 is faster than the circumferential velocity ($V_1$) of the upstream photosensitive drum 211 of the first transferring process unit 250 and as − when the circumferential velocity ($V_2$) of the downstream photosensitive drum 211 of the second transferring process unit 260 is slower than the circumferential velocity ($V_1$) of the upstream photosensitive drum 211 of the first transferring process unit 250.

As shown in FIG. 4, the print trouble area near the perforations 1*a* in the continuous paper 1 becomes smallest when the circumferential velocity difference (circumferential velocity ratio) between the circumferential velocity ($V_1$) of the upstream photosensitive drum 211 of the first transferring process unit 250 and the circumferential velocity ($V_2$) of the downstream photosensitive drum 211 of the second transferring process unit 260 is of the order of +5%, i.e., when the continuous paper 1 is conveyed so that, during printing, the circumferential velocity ($V_2$) of the downstream photosensitive drum 211 of the second transferring process unit 260 becomes about 0.5% faster than the circumferential velocity ($V_1$) of the upstream photosensitive drum 211 of the first transferring process unit 250.

Also, the print trouble area near the perforations 1*a* in the continuous paper 1 becomes larger when the circumferential velocity difference (circumferential velocity ratio) between the circumferential velocity ($V_1$) of the upstream photosensitive drum 211 of the first transferring process unit 250 and the circumferential velocity ($V_2$) of the downstream photosensitive drum 211 of the second transferring process unit 260 is negative (−), i.e., when the continuous paper 1 is conveyed so that during printing, the circumferential velocity ($V_2$) of the downstream photosensitive drum 211 of the second transferring process unit 260 becomes slower than the circumferential velocity ($V_1$) of the upstream photosensitive drum 211 of the first transferring process unit 250.

That is, in the first embodiment, the control section 100 controls the rotation of the upstream photosensitive drum 211 of the first transferring process unit 250 and the rotation of the downstream photosensitive drum 211 of the second transferring process unit 260 so that the circumferential velocity ($V_2$) of the downstream photosensitive drum 211 becomes faster than the circumferential velocity ($V_1$) of the upstream photosensitive drum 211 and slower than the circumferential velocity ($V_s$) of the scuff roller 781, whereby the tension in the continuous paper 1 can also be held in the first transferring process unit disposed at a position away from the conveyor roller pair 78. Therefore, the print trouble area near the perforations 1*a* in the continuous paper 1 can be made smaller. Furthermore, by controlling the rotation of each photosensitive drum 211 such that the circumferential velocity difference is of the order of 0.1 to 0.3%, the print trouble area near the perforations 1*a* in the continuous paper 1 can be made smaller with reliability.

In addition, the control section 100 measures the time that the scuff roller 781 has been used, and also drives the drive motor 787 in accordance with a control value corresponding to the time that the scuff roller 781 has been used. Therefore, even if the scuff roller 781 were worn away because of its use, the continuous paper 1 can be conveyed with an optimum feed force in accordance with the printing condition. As a result, there is no possibility that the continuous paper 1 will tear and slacken, and printing quality can be maintained.

(B) Description of a Modification of the First Embodiment

Figure 5:
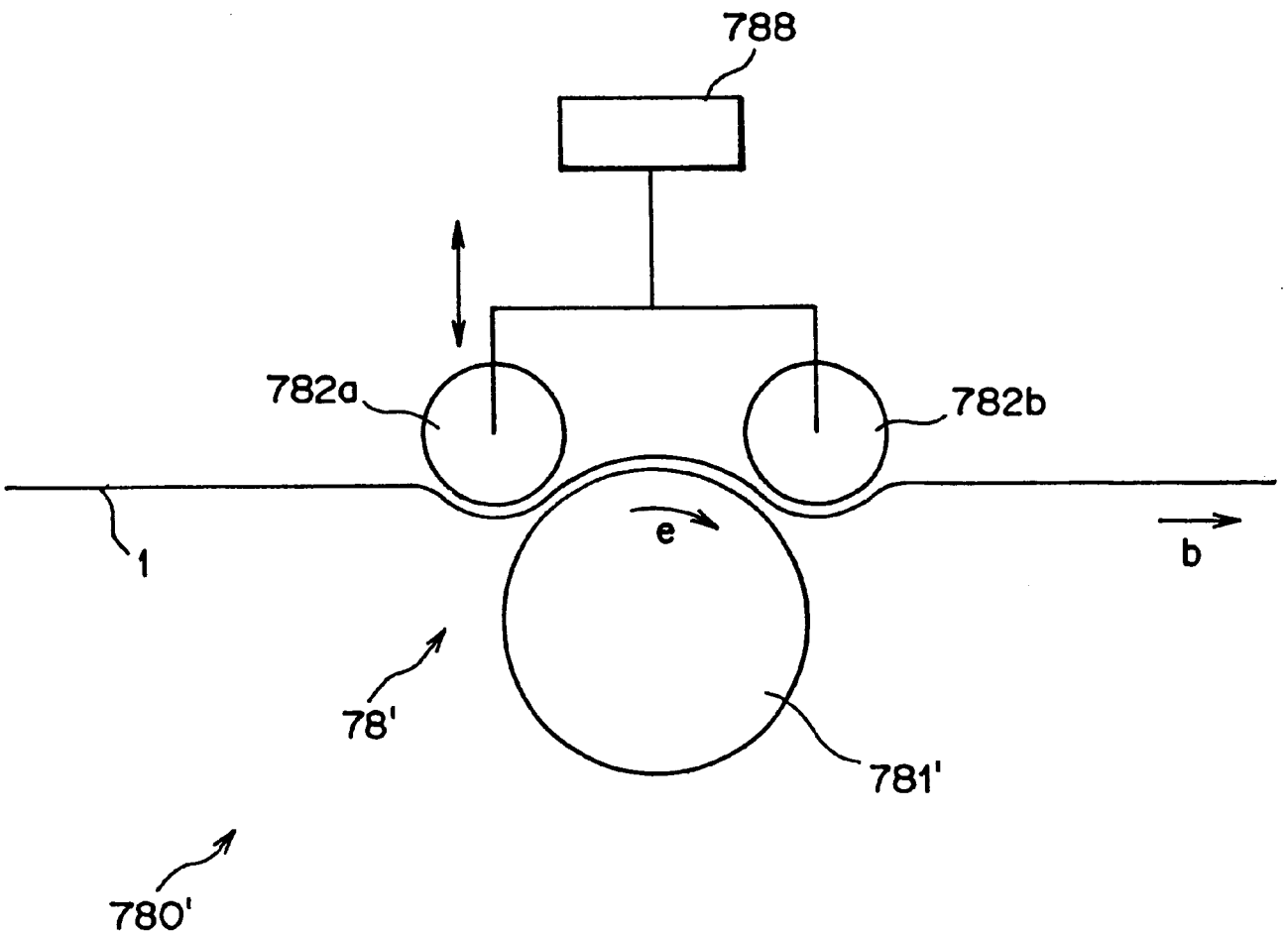
FIG. 5 is a side view schematically illustrating the construction of a feed-force adjustment section in a continuous medium printing apparatus as a modification of the first embodiment of the present invention.

FIG. 5 schematically illustrates the construction of a feed-force adjustment section 780' in a continuous medium printing apparatus as a modification of the first embodiment of the present invention.

The feed-force adjustment section 780' shown in FIG. 5, as with the feed-force adjustment section 780 shown in FIG. 2, varies feed force to be applied to the continuous paper 1, by adjusting the pressure of the pinch rollers 782*a*, 782*b* with respect to the scuff roller 781' so that the scuff pressure of the scuff roller 781' with respect to the continuous paper 1 is adjusted. The feed-force adjustment section 780' is constituted by the scuff roller 781', the pinch rollers 782*a*, 782*b*, and a scuff lever 788.

The scuff roller 781', as with the scuff roller 781 shown in FIG. 2, conveys the continuous paper 1 in sliding contact with the continuous paper 1 and has an outer circumferential surface consisting of metal or the like. The scuff roller 781' is driven to rotate in the printing-time conveying direction (the direction of arrow e in FIG. 5) by a drive motor (not shown).

The position of the scuff lever 788 is switched by the operator in accordance with a paper condition. The operator switches the position of the scuff lever 788 in accordance with the thickness (basis weight) of the continuous paper 1 to be printed.

The pinch rollers 782*a*, 782*b* clamp the continuous paper 1 in cooperation with the scuff roller 781' and are both disposed in parallel with the axis of rotation of the scuff roller 781'. The operator varies the position of the scuff lever 788, whereby the distance between the pinch rollers 782*a*, 782*b* and the scuff roller 781' is varied.

That is, the operator varies the position of the scuff lever 788, whereby the pressure of the pinch rollers 782*a*, 782*b* toward the scuff roller 781' is adjusted. With this, the scuff pressure of the scuff roller 781' with respect to the continuous paper 1 is adjusted so that the feed force to be applied to the continuous paper 1 varies. Thus, the scuff lever 788 functions as a feed-force control section which controls the feed-force adjustment section 780' so that the feed force to be applied to the continuous paper 1 varies according to printing conditions.

The scuff roller 781' and the pinch rollers 782*a*, 782*b* are disposed opposite to each other with the continuous paper 1 therebetween and rotate clamping the continuous paper 1 therebetween, thereby applying feed force to the continuous paper 1. The scuff roller 781' and the pinch rollers 782*a*, 782*b* constitute a conveyor roller pair 78'.

Because the feed-force adjustment section 780' in the continuous medium printing apparatus of the modification of the first embodiment of the present invention is constructed as described supra, the distance between the pinch rollers 782*a*, 782*b* and the scuff roller 781' is adjusted by the position of the scuff lever 788, if the operator adjusts the position of the scuff lever 788 in accordance with the thickness (basis weight) of the continuous paper 1 by controlling the scuff lever 788 when printing is started.

With this, the pressure of the pinch rollers 782*a*, 782*b* to the scuff roller 781' side is adjusted and the continuous paper 1 is conveyed with a feed force optimum to the thickness of the continuous paper 1.

Thus, the continuous medium printing apparatus as the modification of the first embodiment of the present invention can also the same operational effect as the above-mentioned first embodiment. In addition, the construction of the feed-force adjustment section 780' can be simplified and therefore the cost for manufacturing the apparatus can be reduced.

(C) Description of a Second Embodiment

Figure 6:
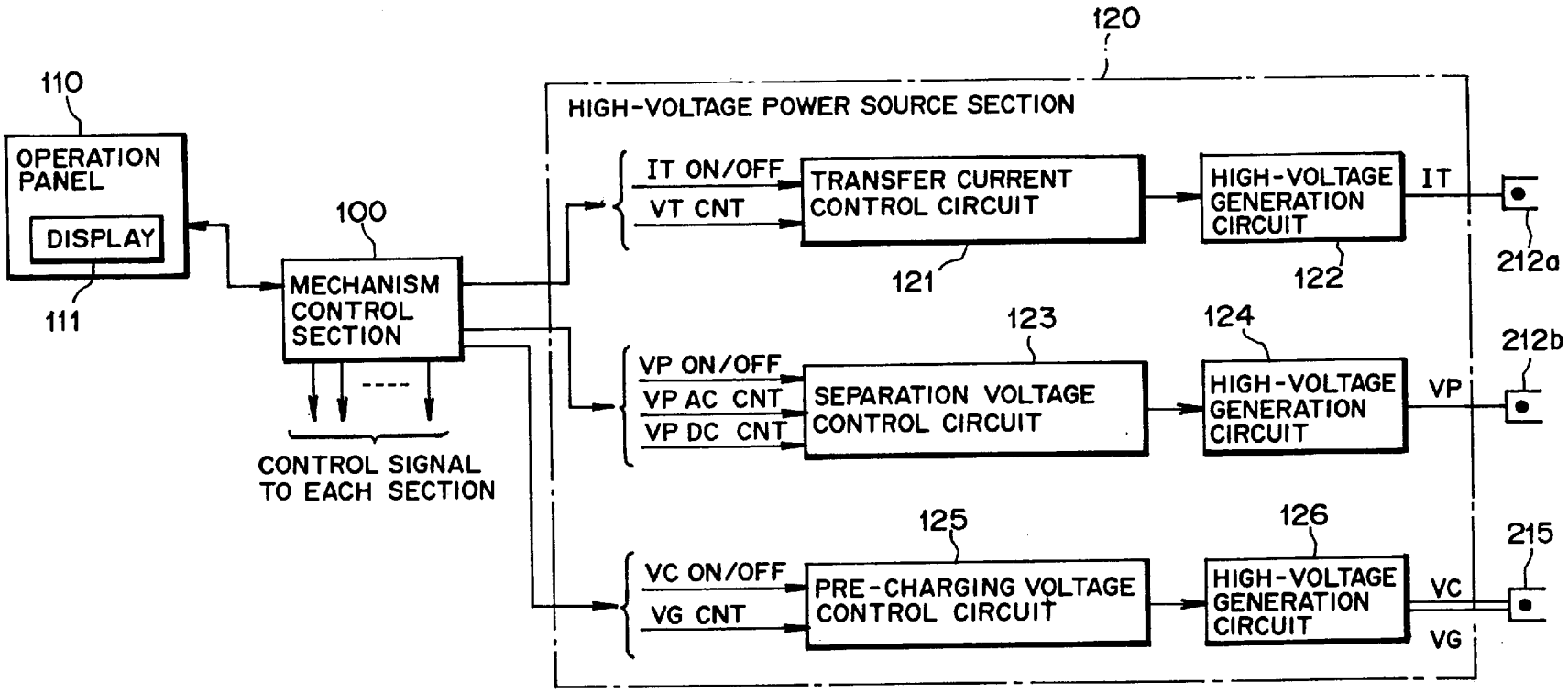
FIG. 6 is a block diagram showing the essential construction of a control system in the continuous medium printing apparatus of a second embodiment.

The continuous medium printing apparatus of a second embodiment of the present invention is provided with a control system such as that shown in FIG. 6 in addition to the same construction as the continuous medium printing apparatus of the first embodiment.

Here, the essential construction of the control system in the continuous medium printing apparatus of the second embodiment will be described with reference to FIGS. 6 and 7. Note that FIG. 6 shows the essential construction of the control system in the continuous medium printing apparatus of the second embodiment; FIG. 7 shows the control voltage which controls transfer current in the continuous medium printing apparatus of the second embodiment.

The control section 100 of the second embodiment, as with the continuous medium printing apparatus of the first embodiment, controls the conveyance system 700, the first transferring process unit 250, the second transferring process unit 260, the first fixing section 410, the second fixing section 420, the stacker 60, the floor 8, the flash-fixer power source 9 and the like. However, the second embodiment is characterized by the operation that is performed when the continuous paper 1 is printed. A description will hereinafter be made of the function of the control section 100 related to the operation that is performed when the continuous paper 1 is printed.

When the continuous paper 1 is printed, the control section 100 controls the conveying operation to be performed by the conveyor tractor 710 and the conveyor roller pair 78, the rotated state of the photosensitive drum 211, the charging operation to be performed by the pre-charger 215, the transfer charger 212*a*, and the separation charger 212*b*, the bias-voltage applying operation to be performed by the developing unit 219 and the like, based on the printing condition (e.g., the basis weight of the continuous paper 1) input from a control panel (see FIG. 6), as described infra with reference to FIGS. 6 and 7, when the continuous paper 1 is printed.

The control section 100 also performs control operation, based on information input from the control panel 110. Note that the control panel 110 is attached to the side or the like of the printing apparatus main body of the second embodiment and is operated by the operator in order to perform input or setting with respect to the continuous paper printing apparatus. This control panel has a display 111 for displaying various states of the continuous medium printing apparatus.

Furthermore, the control section 100 controls the charged states of the transfer charger 212*a*, the separation charger 212*b*, and the pre-charger 215 through a high-voltage source section 120, as shown in FIG. 6.

Here, the high-voltage source section 120 is constituted by a transfer-current control circuit 121 and a first high-voltage generation circuit 122 for controlling transfer current VT with respect to the transfer charger 212*a*, a separating-voltage control circuit 123 and a second high-voltage generation circuit 124 for controlling alternating voltage VP to be supplied to the separation charger 212*b*, and a pre-charging-voltage control circuit 125 and a third high-voltage generation circuit 126 for controlling the grid voltage VG and constant voltage source VC of the pre-charger 215.

The control section 100 gives on-off information IT-ON/OFF (1-bit signal) which turns on or off the pre-charger 212*a* and control voltage VT-CNT which specifies the magnitude of transfer current IT, to the transfer-current control circuit 121 in order to control transfer current IT with respect to the transfer charger 212*a*. If the transfer-current control circuit 121 receives the information IT-ON which turns on the transfer charger 212*a*, the control circuit 121 controls the first high-voltage generation circuit 122, thereby supplying the transfer current IT corresponding to the control voltage VT-CNT to the transfer charger 212*a*.

The control section 100 also gives on-off information VP-ON/OFF (1-bit signal) that turns on or off the separation charger 212*b*, a first control voltage VP-ACCNT that specifies the peak-to-peak (P-P) value VP-(P-P) of alternating voltage VP, and a second control voltage VP-DCCNT that specifies the offset value VP-(DC) of alternating voltage VP, to the separating-current control circuit 212*b* in order to control alternating voltage VP to be supplied to the separation charger 212*b*. If the separating-voltage control circuit 123 receives the information VP-ON that turns on the separation charger 212*b*, the control circuit 123 controls the second high-voltage generation circuit 124, thereby supplying the alternating voltages VP of VP-(P-P) and VP-(D-C) corresponding to the control voltages VP-ACCNT and VP-DCCNT, respectively, to the transfer charger 212*b*.

Furthermore, the control section 100 gives on-off information VC-ON/OFF (1-bit signal) which turns on or off the constant-voltage source VC in the pre-charger 215 and control voltage VG-CNT which specifies the magnitude of grid voltage VG, to the pre-charging-voltage control circuit 125 in order to control the grid voltage VG and constant voltage source VC of the pre-charger 215. If the pre-charging-voltage control circuit 125 receives the information VC-ON which turns on the constant voltage source VC, the control circuit 125 controls the third high-voltage generation circuit 126, thereby supplying the grid voltage VG and constant voltage source VC corresponding to the control voltage VG-CNT to the pre-charger 215.

And the control section 100 controls the charged states of the transfer charger 212*a*, the separation charger 212*b*, and the pre-charger 215, based on information or the like input from the control panel 110.

FIG. 7 is used for describing an electrostatic adsorption force optimum to the basis weight of the continuous paper 1 in each photosensitive drum 211 of the first and second transferring process units 250, 260, and shows the optimum surface potentials VS1, VS2 of the photosensitive drum 211 and the transfer currents IT1, IT2 of the transfer charger 212*a* with respect to the basis weight.

As shown in FIG. 7, the control section 100 has a table including the optimum values or the like of the surface potentials VS1, VS2 of each photosensitive drum 211 and the transfer currents IT1, IT2 of each transfer charger 212*a* in the first and second transferring process units 250, 260 in accordance with various kinds of paper thickness (paper basis weight).

The control section 100 judges the thickness (basis weight) of the continuous paper 1 attached to the printing apparatus from a printing condition input from the control panel 110, and obtains the surface potentials VS1, VS2 of each photosensitive drum 211 of the first and second transferring process units 250, 260 corresponding to the basis weight from the table shown in FIG. 7.

And the control section 100 controls the grid voltage VG or the like of each photosensitive drum 211 so that the surface potentials of the upstream photosensitive drum 211 and the downstream photosensitive drum 211 become VS1 and VS2, thereby controlling the pre-chargers 215. At this time, the control section 100 performs control so that the surface potential VS2 of the downstream photosensitive drum 211 of the second transferring unit 260 becomes greater than the surface potential VS1 of the upstream photosensitive drum 211 of the first transferring unit 250, and therefore functions as an electric potential control section.

The control section 100 also controls the transfer charger 212*a* of each photosensitive drum 211 so that the charged potentials of the continuous paper 1 become IT1 and IT2. At this time, the control section 100 controls the electric potential of the continuous paper 1 so that the charged potential of the continuous paper 1 in the downstream photosensitive drum 211 of the second transferring unit 260 becomes greater than that of the continuous paper 1 in the upstream photosensitive drum 211 of the first transferring unit 250, and therefore functions as a potential control section.

Furthermore, the control section 100 varies the surface potentials VS1, VS2 of each photosensitive drum 211 and the charged potentials IT1, IT2 of the continuous paper 1 in accordance with a print area rate in the continuous paper 1, thereby varying the electrostatic adsorption force of the continuous paper 1 with respect to each photosensitive drum 211. Therefore, the control section 100 obtains a print area rate, i.e., an area ratio of a toner image to a paper area from a print instruction given by the host computer and then controls the high-voltage source section 120 so that the electrostatic adsorption force on each photosensitive drum 211 is increased when the print area rate is high and decreased when the print area rate is low.

A description will be made of a method of controlling the conveyance system in performing duplex printing on the continuous paper 1, which is carried out by the continuous medium printing apparatus of the second embodiment constructed as described supra, with FIG. 8.

Figure 8:
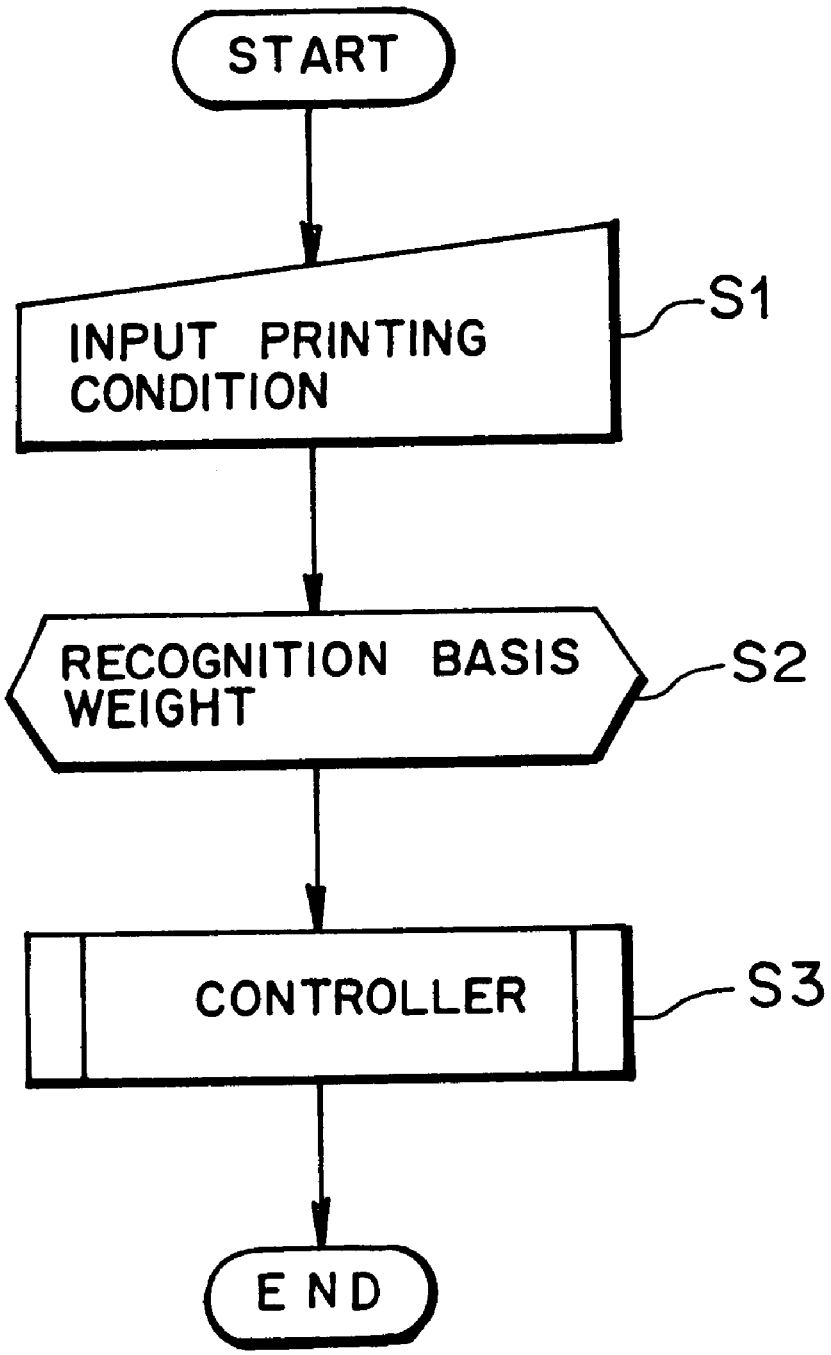
FIG. 8 is a flowchart for describing a method of determining control conditions for the conveyance system in the continuous medium printing apparatus of the second embodiment.

FIG. 8 shows a flowchart (steps S1 to S3) for describing a method of determining control conditions for the conveyance system in the continuous medium printing apparatus of the second embodiment.

If the operator inputs printing conditions (including the basis weight of the continuous paper 1) from the control panel 110 (step S1), the control section 100 recognizes the basis weight (thickness) of the continuous paper 1 from the input printing conditions (step S2) and obtains the optimum control condition for the conveyance system corresponding to the basis weight from the table shown in FIG. 7 (step S3).

For instance, in the control panel 110, when a basis weight of 135 kg/m$^3$ is input, the control section 100 obtains the surface potential VS1 (in the second embodiment, 650 V) of the photosensitive drum 211 of the first transferring process unit 250 corresponding to the basis weight of 135 kg/m$^3$ from the table shown in FIG. 7 and controls the grid voltage VG or the like of the pre-charger 215 so that the surface potential of the photosensitive drum 211 goes to 650 V.

The control section 100 also obtains the charging voltage IT1 (in the second embodiment, 400 $\mu$V) of the transfer charger 212*a* in the photosensitive drum 211 of the first transferring process unit 250 corresponding to the basis weight of 135 kg/m$^3$ and controls the transfer charger 212*a* by the charging current 400 $\mu$A.

Similarly, the control section 100 obtains the surface potential VS2 (in the second embodiment, 800 V) of the photosensitive drum 211 of the second transferring process unit 260 corresponding to the basis weight of 135 kg/m$^3$ and controls the grid voltage VG or the like of the pre-charger 215 so that the surface potential of the photosensitive drum 211 goes to 800 V. In addition, the control section 100 obtains the charging current IT2 (in the second embodiment, 600 $\mu$A) of the transfer charger 212*a* in the photosensitive drum 211 of the second transferring process unit 260 corresponding to the basis weight of 135 kg/M$^3$ and controls the transfer charger 212*a* by the charging voltage 600 V.

And the control section 100 conveys and prints the continuous paper 1 by the conveyance system 700 under the control conditions obtained in the aforementioned manner.

In the second embodiment, as with the aforementioned first embodiment, the pressure (scuff pressure) of the pinch roller 782 toward the scuff roller 781 side is adjusted based on the printing conditions input from the control panel 110, whereby the continuous paper 1 is conveyed with a feed force optimum to the thickness of the continuous paper 1.

Thus, the continuous medium printing apparatus as the second embodiment of the present invention is capable of obtaining the same operational effect as the above-mentioned first embodiment. Besides this effect, the control section 100 recognizes the thickness (basis weight) of the continuous paper 1 attached to the printing apparatus from the printing conditions input from the control panel 110 and also controls each photosensitive drum 211 of the first and second transferring process units 250, 260, based on a table such as the one shown in FIG. 7. Furthermore, the control section 100 controls the surface potential of each photosensitive drum so that the surface potential VS2 of the downstream photosensitive drum 211 of the second transferring unit 260 becomes greater than the surface potential VS1 of the upstream photosensitive drum 211 of the first transferring unit 250. Therefore, the electrostatic adsorption force of the continuous paper 1 with respect to the downstream photosensitive drum 211 of the second transferring process unit 260 becomes greater than that of the continuous paper 1 with respect to the upstream photosensitive drum 211 of the first transferring process unit 250.

With this, the feed force, produced by the conveyor roller pair 78 disposed at a downstream position of the conveying path of the continuous paper 1 from the second transferring process unit 260, can be transmitted to the first transferring process unit 250 and the second transferring process unit 260, and consequently, the tension in the continuous paper 1 can also be held in the first transferring process unit 250 disposed at a position away from the conveyor roller pair 78.

In the first transferring process unit 250, therefore, the perforations 1*a* (see FIG. 13) in the continuous paper 1 are stretched. Therefore, the mountain and the valley (or unevenness) of the continuous paper 1 with the perforations 1*a* as apices become smaller and the gap between the photosensitive drum 211, which transfers a toner image to the continuous paper 1, and the continuous paper 1 becomes smaller. As a result, print trouble, such as a shear in printing, an omission of printing and the like, or the occurrence of unevenness, near the perforations 1*a* can be suppressed to the minimum.

The control section 100 also controls the surface potentials of the photosensitive drums 211 by obtaining the surface potentials VS1, VS2 of the photosensitive drums 211 of the first and second transferring process units 250, 260 optimum to the paper thickness obtained from a table such as that shown in FIG. 7. Therefore, the electrostatic adsorption force of the continuous paper 1 with respect to each photosensitive drum 211 can reliably be controlled and printing quality can be enhanced.

In addition, the control section 100 controls the pre-charger 215 by controlling each grid voltage VG or the like so that the surface potentials of the photosensitive drums 211, 211 become VS1 and VS2. Thus, the electrostatic adsorption force of the continuous paper 1 with respect to each photosensitive drum 211 can reliably be controlled and printing quality can be enhanced, and in addition to these, a rise in the cost for manufacturing the apparatus can be suppressed, because the existing pre-charger 215 can be used for suppressing the behavior of the continuous paper 1.

Moreover, the control section 100 controls the transfer charger 212*a* by obtaining transfer currents IT1, IT2 from a table such as that shown in FIG. 7 so that the charged potential of the continuous paper 1 becomes a desired potential. Therefore, the electrostatic adsorption force of the continuous paper 1 with respect to each photosensitive drum 211 can reliably be controlled and printing quality can be enhanced.

The control section 100 also controls the potential in the continuous paper 1 by employing the transfer chargers 212*a* so that the charged potential of the continuous paper 1 on the downstream photosensitive drum 211 of the second transferring unit 260 becomes greater than that of the continuous paper 1 on the upstream photosensitive drum 211 of the first transferring unit 250. Therefore, the electrostatic adsorption force of the continuous paper 1 with respect to each photosensitive drum 211 can reliably be controlled and printing quality can be enhanced, and in addition to these, a rise in the cost for manufacturing the apparatus can be suppressed, because the existing pre-charger 215 can be used for suppressing the behavior of the continuous paper 1.

Furthermore, the control section 100 varies the electrostatic adsorption force of the continuous paper 1 with respect to each photosensitive drum 211 by varying the surface potentials VS1, VS2 of the photosensitive drums 211, 211 and the charged currents IT1, IT2 of the continuous paper 1 in accordance with a print area rate in the continuous paper 1. Therefore, even when printing is performed up to the vicinity of the perforations la formed in the continuous paper 1, a print trouble area near the perforations 1*a* can be reduced and printing quality can be enhanced.

Note that in the above-mentioned second embodiment, as with the first embodiment, the operator inputs various printing conditions from the control panel 110 and the control section 100 controls the surface potentials VS1, SV2 of the photosensitive drums 211, 211 and the transfer currents IT1, IT2, based on the printing information input from the control panel 110. However, the second embodiment is not limited to this control, but may be modified within the scope of the invention.

For example, the second embodiment may be provided with the feed-force adjustment section 780' (see FIG. 5) in the aforementioned modification of the first embodiment instead of the feed-force adjustment 780. The control section 100 is capable of obtaining the same operational effect as the above-mentioned continuous medium printing apparatus of the second embodiment, by judging the basis weight (thickness) of the continuous paper 1 from the position of the scuff lever 788 of the feed-force adjustment section 780' switched by the operator and also controlling the surface potentials VS1, SV2 of the photosensitive drums 211, 211 and the transfer currents IT1, IT2, based on the table shown in FIG. 7.

(D) Description of a Third Embodiment

A continuous medium printing apparatus as a third embodiment of the present invention performs printing on the continuous paper 1 similarly as in the continuous medium printing apparatus shown in FIG. 1 and is provided with an automatic feed-force adjustment unit 800 instead of the conveyor roller pair 78 in the continuous medium printing apparatus shown in FIG. 1.

Figure 9:
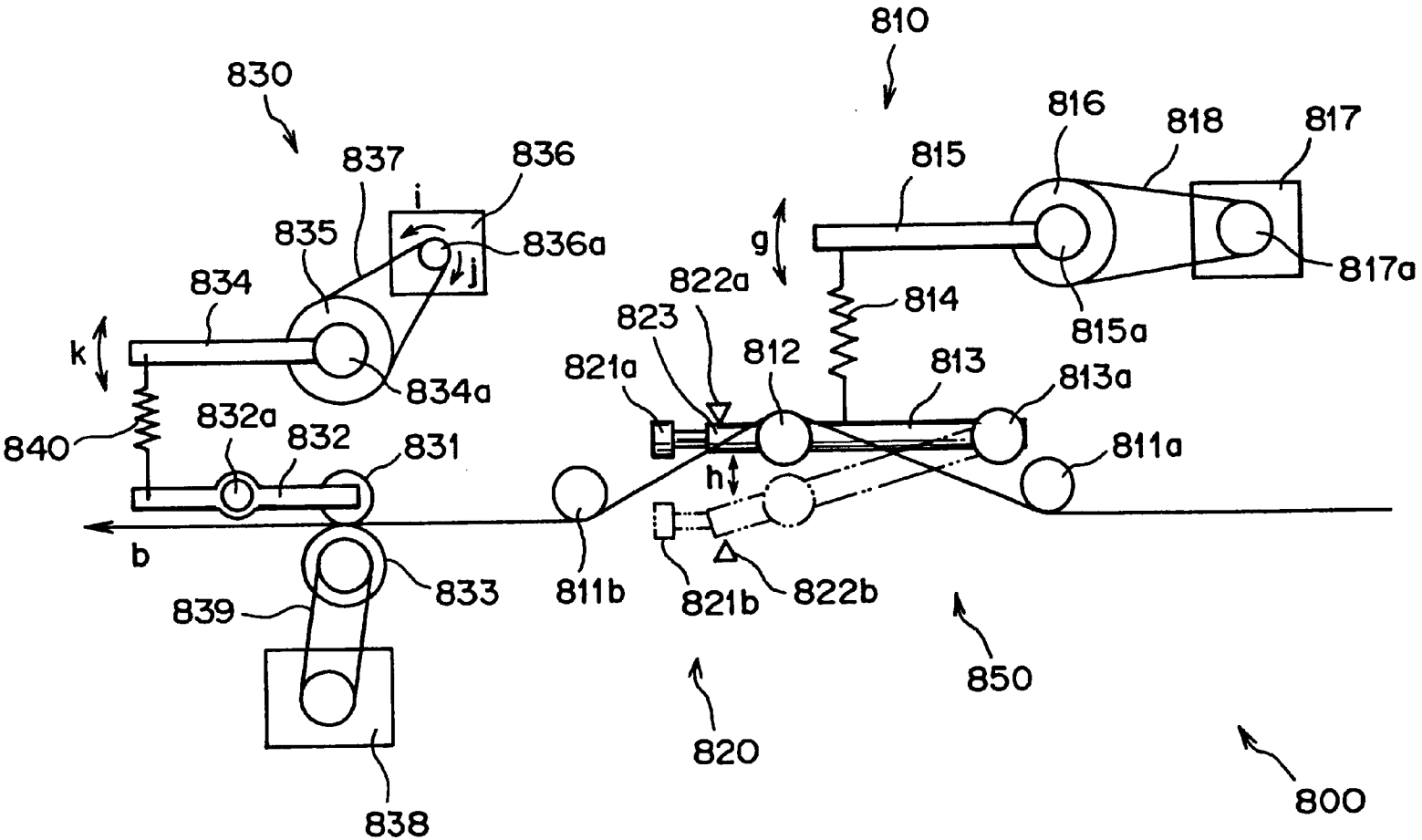
FIG. 9 is a schematic side view showing the construction of the automatic feed-force adjustment unit of a continuous medium printing apparatus as a third embodiment of the present invention.
Figure 10:
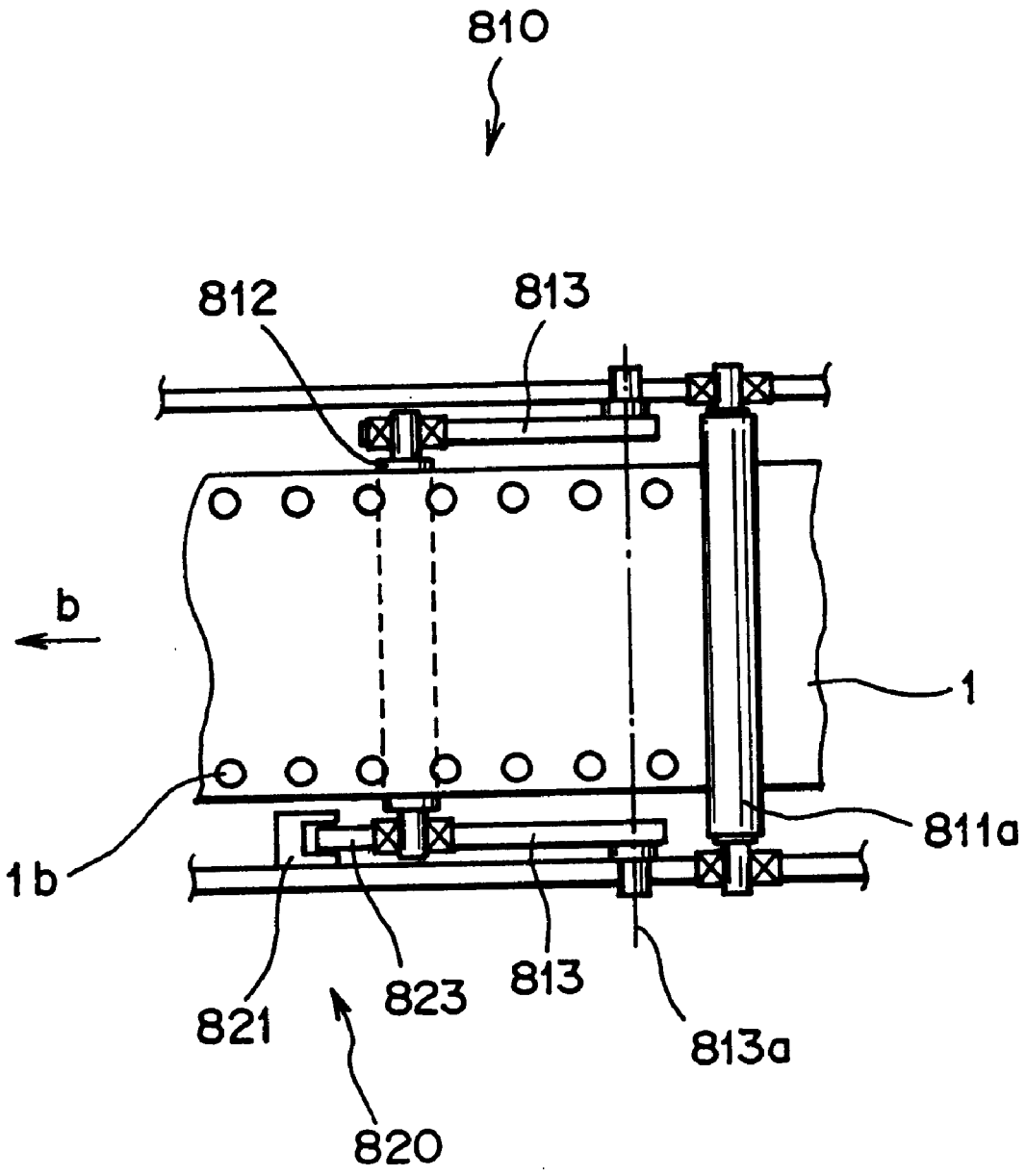
FIG. 10 is a plan view of the buffer section and the deflection-quantity detection section of the continuous medium printing apparatus as the third embodiment of the present invention.
Figure 11:
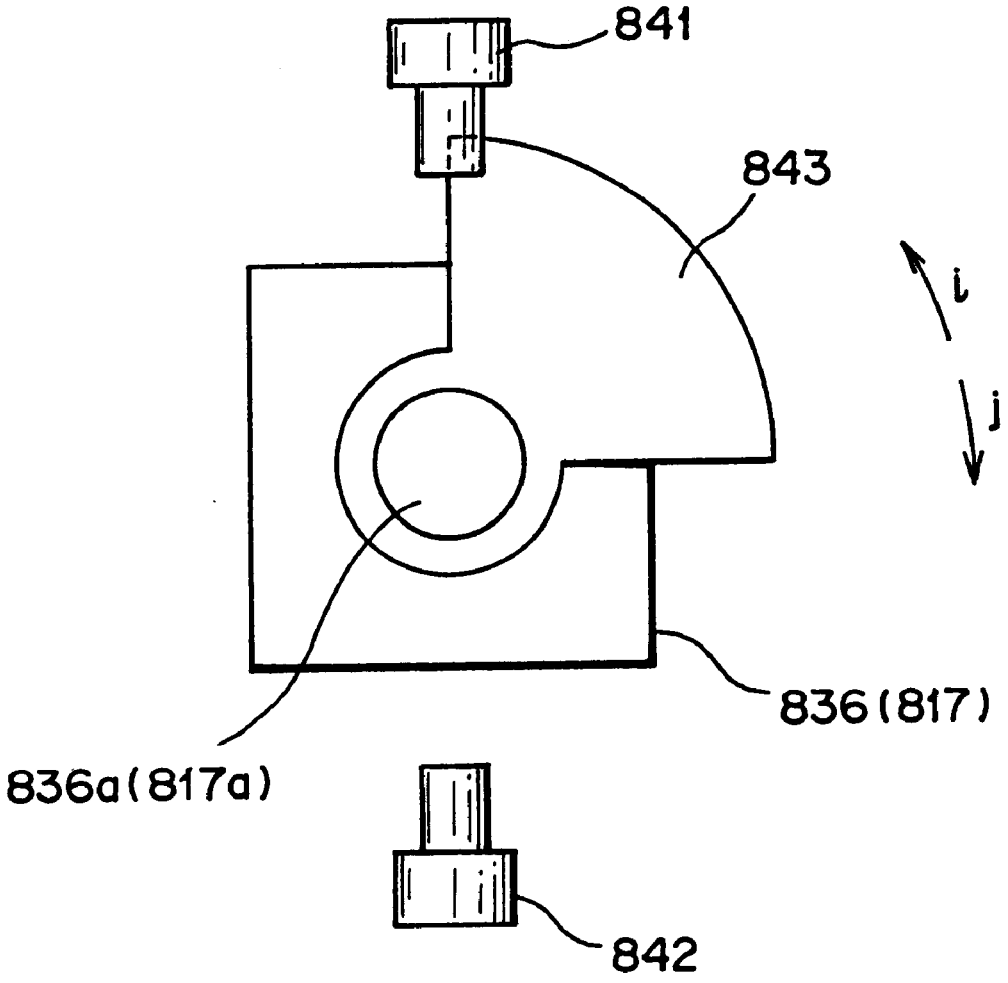
FIG. 11 is a side view showing the construction of a position detection sensor in the continuous medium printing apparatus as the third embodiment of the present invention which detects the position of a butter-pressure switching motor.

FIG. 9 schematically shows the construction of the automatic feed-force adjustment unit 800 of the continuous medium printing apparatus as the third embodiment of the present invention, FIG. 10 shows the buffer section 810 and the deflection-quantity detection section 820 of the automatic feed-force adjustment unit 800, and FIG. 11 shows the construction of the position detection sensor of the deflection-quantity detection section 820 which detects the position of a butter-pressure switching motor.

The automatic feed-force adjustment unit 800 is disposed along the conveying path of the continuous paper 1 and automatically adjusts feed force to be applied to the continuous paper 1. The automatic feed-force adjustment unit 800 is disposed on a downstream side of the conveying path of the continuous paper 1 from the first fixing section 410 and the second fixing section 420 and is constituted by the buffer section 810, the deflection-quantity detection 820, and the feed-force adjustment section 830, as shown in FIG. 9.

The feed-force adjustment section 830 varies feed force to be applied to the continuous paper 1 by adjusting the pressure of a pinch roller 831 toward a scuff roller 832 side so that the scuff pressure of the scuff roller 832 with respect to the continuous paper 1 is adjusted. The feed-force adjustment section 830 is disposed at a downstream position of the conveying path of the continuous paper 1 from the buffer section 810 and is constituted by the pinch roller 831, the scuff roller 833, first arm members 832, 832, pinch pressure springs (first elastic members) 840, 840, first lever members 834, 834, a scuff-pressure switching motor (first drive mechanism) 836, and a scuff roller motor 838.

The pinch roller 831 is disposed in parallel with the lateral direction of the continuous paper 1 so that it can abut one surface (in the third embodiment the lower surface) of the continuous paper 1. The opposite ends of the pinch roller 831 are freely rotatably clamped by one end (in FIG. 9 the left end) of each of the first arm members 832, 832 disposed in parallel with each other. Note that it is preferable that the pinch roller 831 be constituted by resin having no elasticity, such as polyoxymethylene (POM).

The first arm members 832, 832 are attached at each intermediate portion thereof to the frame structure of the printing apparatus so that they are pivotable on a second arm shaft 832*a* parallel with the rotating shaft of the pinch roller 831.

At the position across the continuous paper 1 from the pinch roller 831, the scuff roller 833 is disposed in parallel with the pinch roller 831. This scuff roller 833, as with the scuff roller 781 shown in FIGS. 1 and 2, conveys the continuous paper 1 in sliding contact with the continuous paper 1 and has an outer circumferential surface constituted by material whose coefficient of friction is low, such as metal. This scuff roller 833 is driven to rotate in the printing-time conveying direction (the direction of arrow b in FIG. 9) of the continuous paper 1 by the scuff roller motor 838 through a belt 839.

The first lever members 834, 834 are disposed above the first arm members 832, 832 and in parallel with each other. One end (in FIG. 9 the left end) of each lever member 834 is attached to one end (in FIG. 9 the upper end) of the pinch pressure spring 840, while the other end (in FIG. 9 the right end) of each lever member 834 is attached so that it is pivotable on the first lever shaft 834*a* parallel with the rotating shaft of the pinch roller 831.

A pulley 835 is coaxially mounted on the first lever shaft 834*a*. Near the first lever shaft 834*a*, the rotating shaft 836*a* of the scuff-pressure switching motor 836 is disposed in parallel with the first lever shaft 834*a*. Between the pulley 835 and the rotating shaft 836*a*, a belt 837 is looped.

Between one end (the left end in FIG. 9) of one of the first arm members 832 and one end (the left end in FIG. 9) of one of the first lever members 834 and between one end of the other arm member 832 and one end of the other lever member 834, the pinch pressure springs 840 are interposed respectively and serve as first elastic members that apply scuff pressure to the scuff roller 833 through the pinch rollers 831.

The scuff-pressure switching motor 836 is constituted, for example, by a stepping motor and rotates the rotating shaft 836*a*, thereby rotating the pulley 835 through the belt 837. The rotation of the pulley 835 causes the first lever members 834, 834 to pivot on the first lever shaft 834*a* in the directions indicated by an arrow k in FIG. 9. And the scuff-pressure switching motor 836 functions as a first drive mechanism which drives the first lever members 834, 834 to rotate on the first lever shaft 834*a* in order to adjust scuff pressure, by adjusting the angle of the first lever members 834, 834 with respect to the first lever shaft 834*a*.

As shown in FIG. 11, a fan-type light intercepting member 843 is mounted on the shaft 836*a* of the scuff-pressure switching motor 836. Near the light intercepting member 843, a home-position detection sensor 841 and an overrun detection sensor 842 are disposed.

If the rotating shaft 836*a* of the scuff-pressure switching motor 836 rotates, the light intercepting member 843 moves in the direction of arrow i or j in FIG. 11. The home-position detection sensor 841 and the overrun detection sensor 842 are disposed so that the light intercepting member 843 can pass through the space between a light-emitting element and a light-receiving element in the home-position detection sensor 841 and the space between a light-emitting element and a light-receiving element in the overrun detection sensor 842.

For example, in FIG. 11, it is shown that the home-position detection sensor 841 has detected the light intercepting member 843. This position represents the operation start position (home position) of the scuff-pressure switching motor 836, i.e., the state of the initialization of the scuff pressure (pinch pressure) that is produced by the pinch roller 831 and the scuff roller 833.

If the scuff-pressure switching motor 836 raises the second lever member 815 from the position shown in FIG. 11 by rotating the shaft 817*a* in the direction of arrow j, the light intercepting member 843 rotates. If the scuff-pressure switching motor 836 further rotates so that the light intercepting member 843 passes through the space between the light-emitting element and the light-receiving element in the overrun detection sensor 842 and if the overrun detection sensor 842 detects the light intercepting member 843, the overrun detection sensor 842 transmits a detection signal to the control section 100.

And the control section 100 receiving the detection signal from the home-position detection sensor 841 or the overrun detection sensor 842 outputs an alarm signal to the display 111, or a display (not shown), etc.

If, on the other hand, the scuff-pressure switching motor 836 lowers the first lever member 834 by rotating the shaft 836*a* in the direction of arrow i and if the home-position detection sensor 841 detects the light intercepting member 843, the home-position detection sensor 841 transmits a detection signal to the control section 100.

Note that the pivotable angle of the first lever member 834 can be adjusted by adjusting the central angle (in FIG. 11 about 90 degrees) of the fan-type light intercepting member 843.

When the printing apparatus is started, the control section 100 rotates the scuff-pressure switching motor 836 by a predetermined angle in the directions of arrows i and j, respectively, so that the home-position detection sensor 841 can recognize the light intercepting member 843. And the control section 100 sets the scuff-pressure switching motor 836 to an initial position (home position) such as the one shown in FIG. 11.

The buffer section 810 sucks up the deflection of the continuous paper 1 produced due to a change in the feed force to be applied to the continuous paper 1 and is constituted by driven rollers 811*a*, 811*b*, a buffer roller 812, second arm members 813, 813, buffer pressure springs (second elastic members) 814, 814, second lever members 815, 815, a pulley 816, and a buffer-pressure switching motor (second drive mechanism) 817.

As shown in FIGS. 9 and 10, the buffer roller 812 is disposed in parallel with the lateral direction of the continuous paper 1 so that it can abut the lower surface of the continuous paper 1. The opposite ends of the buffer roller 812 are freely rotatably clamped by one end (in FIG. 9 the left end) of each of the second arm members 813, 813 disposed in parallel with each other.

The second arm members 813, 813 are disposed in parallel with each other. One end (in FIG. 9 the left end) of each second arm member 813 freely rotatably clamps the buffer roller 812, while the other end (in FIG. 9 the right end) is attached to the frame structure or the like of the printing apparatus so that it is pivotable on the second arm shaft 813*a* parallel with the rotating shaft of the buffer roller 812.

The buffer roller 812 is disposed by the second arm members 813, 813 so that it is movable upward (the deflection direction of the continuous paper 1), and rotates as a follower in response to the conveyance of the continuous paper 1, while abutting one side (in FIG. 9 the lower side) of the continuous paper 1.

At an upstream position of the conveying path of the continuous paper 1 from the buffer roller 812, the driven roller 811*a* is freely rotatably disposed in parallel with the rotating shaft of the buffer roller 812. Similarly, at a downstream position of the conveying path of the continuous paper 1 from the buffer roller 812, the driven roller 811*b* is freely rotatably disposed in parallel with the rotating shaft of the buffer roller 812. The driven rollers 811*a*, 811*b* function as a pair of driven rollers which rotate as a follower in response to the conveyance of the continuous paper 1, while abutting the opposite side (in FIG. 9 the upper side) of the continuous paper 1 from the side that the buffer roller 812 abuts.

At upward positions from the second arm members 813, 813, upper stoppers (stopper) 822*a* are disposed for preventing the. second arm members 813, 813 from pivoting upward beyond the stoppers 822*a*. The upper stoppers 822*a* represent the upper limit position of the deflection quantity of the continuous paper 1.

At predetermined downward positions from the second arm members 813, 813, specifically downward positions (shown by a two-dotted line in FIG. 9) from the second arm members 813, 813 in the case where the buffer roller 812 is disposed so that the buffer roller 812 and the continuous paper 1 do not interfere with each other between the driven rollers 811*a*, 811*b*, lower stoppers (stopper) 822*b* are disposed for preventing the second arm members 813, 813 from pivoting downward beyond the stoppers 822*b*. The lower stoppers 822*b* represent the lower limit position of the deflection quantity of the continuous paper 1.

The buffer pressure springs 814, 814 are each interposed between each second arm member 813 and each second lever member 815 and apply an upward buffer pressure to the continuous paper 1. One end (in FIG. 9 the lower end) of each buffer pressure spring 814 is attached to the intermediate portion of each second arm member 813, while the other end is attached to one end (in FIG. 9 the left end) of each second lever member 815.

The second lever members 815, 815 are disposed above the second arm members 813, 813 and in parallel with each other. One end (in FIG. 9 the left end) of each lever member 815 is attached to the upper end of the buffer pressure spring 814, while the other end (in FIG. 9 the right end) of each lever member 815 is attached so that it is pivotable on the second lever shaft 815*a* parallel with the rotating shaft of the buffer roller 812.

A pulley 816 is coaxially mounted on the second lever shaft 815*a*. Near the second lever shaft 815*a*, the rotating shaft 817*a* of the buffer-pressure switching motor 817 is disposed in parallel with the second lever shaft 815*a*. Between the pulley 816 and the rotating shaft 817*a*, a belt 818 is looped.

The buffer-pressure switching motor 817 is constituted, for example, by a stepping motor and rotates the rotating shaft 817*a*, thereby rotating the pulley 816 through the belt 818. The rotation of the pulley 818 causes the second lever members 815, 815 to pivot on the second lever shaft 815*a* in the directions indicated by an arrow g in FIG. 9.

And the control section 100 rotates the buffer-pressure switching motor 817, thereby varying the position of one end (in FIG. 9 the left end) of each second lever member 815. The variation in the position of the second lever member 815 varies the length of each buffer pressure spring 814, whereby buffer pressure can be adjusted.

That is, the buffer-pressure switching motor 817 functions as a second drive mechanism which drives the second lever members 815, 815 to rotate on the second lever shaft 815*a* in order to adjust buffer pressure, by adjusting the angle of the second lever members 815, 815 with respect to the second lever shaft 815*a*.

And the control section 100 adjusts the angle of the buffer-pressure switching motor 817 in accordance with the printing conditions for the continuous paper 1 input from the display 111 or the like, thereby controlling buffer pressure so that the buffer pressure corresponds to various kinds of continuous paper 1.

The second arm members 813, 813, the second lever members 815, 815, and the buffer pressure springs 814, 814 function as an urging mechanism which urges the buffer roller 812 upwardly to apply buffer pressure to the continuous paper 1 in the deflection direction (in the third embodiment, upward) of the continuous paper 1.

The second arm members 813, 813, the second lever members 815, 815, the buffer pressure springs 814, 814, and the buffer-pressure switching motor 817 function as a buffer-pressure adjustment section which adjusts buffer pressure to be applied to the continuous paper 1 by the buffer controller 812.

As shown in FIG. 11, in the buffer-pressure switching motor 817, as with the scuff-pressure switching motor 836, a fan-type light intercepting member 843 is mounted on the shaft 817*a* thereof. Near the light intercepting member 843, a home-position detection sensor 841 and an overrun detection sensor (overrun sensor) 842 are disposed.

The home-position detection sensor 841 and the overrun detection sensor 842 are both constituted by an optical sensor consisting of a light-emitting element and a light-receiving element. If the rotating shaft 817*a* of the scuff-pressure switching motor 817 rotates, the light intercepting member 843 moves in the direction of arrow i or j. The home-position detection sensor 841 and the overrun detection sensor 842 are disposed so that the light intercepting member 843 can pass through the space between the light-emitting element and the light-receiving element in the home-position detection sensor 841 and the space between the light-emitting element and the light-receiving element in the overrun detection sensor 842.

For instance, in FIG. 11, it is shown that the home-position detection sensor 841 has detected the light intercepting member 843. This position represents the operation start position (home position) of the buffer-pressure switching motor 817, i.e., the state of the initial position of the buffer roller 812.

If the buffer-pressure switching motor 817 raises the second lever member 815 from the position shown in FIG. 11 by rotating the shaft 817*a* in the direction of arrow j, the light intercepting member 843 rotates. If the buffer-pressure switching motor 817 further rotates so that the light intercepting member 843 passes through the space between the light-emitting element and the light-receiving element in the overrun detection sensor 842 and if the overrun detection sensor 842 detects the light intercepting member 843, the overrun detection sensor 842 transmits a detection signal to the control section 100.

And the control section 100 receiving the detection signal from the home-position detection sensor 841 or the overrun detection sensor 842 outputs an alarm signal to the display 111, or a display (not shown), etc.

That is, the home-position detection sensor 841 and the overrun detection sensor 842 function an overrun sensor which detects an overrun state by the rotational angle of the buffer-pressure switching motor 817.

If, on the other hand, the buffer-pressure switching motor 817 lowers the second lever member 815 by rotating the shaft 817*a* in the direction of arrow i and if the home-position detection sensor 841 detects the light intercepting member 843, the home-position detection sensor 841 transmits a detection signal to the control section 100.

Note that the pivotable angle of the second lever member 813, i.e., the upward movable distance of the buffer roller 812 can be adjusted by adjusting the central angle (in FIG. 11 about 90 degrees) of the fan-type light intercepting member 843.

When the printing apparatus is started, the control section 100 rotates the buffer-pressure switching motor 817 by a predetermined angle in the directions of arrows i and j, respectively, so that the home-position detection sensor 841 can recognize the light intercepting member 843. And the control section 100 sets the scuff-pressure switching motor 836 to an initial position (home position) such as the one shown in FIG. 11.

One (in FIG. 10 the lower arm member) of the second arm members 813, 813 has an end portion 823, which functions as a light intercepting portion, on the opposite side (in FIGS. 9 and 10, the left side) from the second arm shaft 813*a*.

At the upper limit position where the deflection quantity of the continuous paper 1 goes to an upper limit value, i.e., the position where the upper surfaces of the second arm members 813, 813 abut the upper stoppers 822*a*, 822*a*, a first position detection sensor 821*a* is disposed for detecting the light intercepting section 823 (second arm member 813) and detects that the second arm member 813 has reached the upper limit position where the deflection quantity of the continuous paper 1 goes to a predetermined upper limit value.

On the other hand, at the position where the lower surfaces of the second arm members 813, 813 abut the lower stoppers 822*b*, 822*b*, a second position detection sensor 821*b* is disposed for detecting the light intercepting section 823 (second arm member 813) and detects that the second arm member 813 has reached the lower position where the deflection quantity of the continuous paper 1 goes to a predetermined lower limit value.

The first position detection sensor 821*a* and the second position detection sensor 821*b* are each constituted, for example, by an optical sensor consisting of a light-emitting portion and a light-receiving portion. If the first position detection sensor 821*a* detects that the light intercepting portion 823 of the second arm member 813 has reached the space between the light-emitting portion and the light-receiving portion, the first sensor 821*a* informs the control section 100 that the second arm members 813, 813 have reached the upper limit position (i.e., an overrun state) . Similarly, if the second position detection sensor 821*b* detects the light intercepting portion 823 of the second arm member 813, the second sensor 821*b* informs the control section 100 that the second arm members 813, 813 have reached the lower limit position (i.e., an overrun state).

Thus, the light intercepting portion 823, the first position detection sensor 821*a*, and the second position detection sensor 821*b* function a deflection quantity detection section 820 which detects the position of the buffer roller 812 as the deflection quantity of the continuous paper 1. The first position detection sensor 821*a* and the second position detection sensor 821*b* function as an overrun sensor which detects that the deflection quantity of the continuous paper 1 has gone to an overrun state in which the deflection quantity of the continuous paper 1 exceeds an allowable value.

When the control section 100 receives a signal, which represents the detection of the light intercepting portion 823 (second arm member 813), from the first position detection sensor 821*a*, the control section 100 controls the feed-force adjustment section 830 so that the scuff pressure, which is produced by the pinch roller 831 and the scuff roller 833, is increased. More specifically, if the control section 100 receives a signal representing the detection of the light intercepting portion 823 from the first position detection sensor 821*a*, the control section 100 controls the scuff-pressure switching motor 836 so that the motor 836 is rotated in the direction of increasing scuff pressure (in FIG. 9 the direction of arrow j).

In addition, when the control section 100 receives a signal, which represents the detection of the light intercepting portion 823 (second arm member 813), from the second position detection sensor 821*b*, the control section 100 controls the feed-force adjustment section 830 so that the scuff pressure, which is produced by the pinch roller 831 and the scuff roller 833, is decreased. More specifically, if the control section 100 receives a signal representing the detection of the light intercepting portion 823 from the second position detection sensor 821*b*, the control section 100 controls the scuff-pressure switching motor 836 so that the motor 836 is rotated in the direction of decreasing scuff pressure (in FIG. 9 the direction of arrow i).

Furthermore, when the first position detection sensor 821*a* or the second position detection sensor 821*b* detects the light intercepting portion 823, the control section 100 (feed-force control section) measures a continuous time period of detecting the second arm member 813 by each sensor. When the detected continuous time period is compared with a predetermined reference time period (predetermined time period) and exceeds the reference time period, the control section 100 displays an alarm on the display 111 or the like.

When the continuous time period of detecting the second arm member 813 by the first position detection sensor 821*a* is 20 sec or greater, for example, the control section 100 judges that the continuous paper 1 cannot be stretched any longer due to the tear of the continuous paper 1 or the like, and gives the alarm of that effect to the operator, for example, by displaying that effect on the display 111. When the continuous time period of detecting the second arm member 813 detected by the second position detection sensor 821*b* is 20 sec or greater, the control section 100 judges that the tension in the continuous paper 1 has gone to an overloaded state because of the conveyance failure of the continuous paper 1 or the like, and gives the alarm of that effect to the operator in order to eliminate that cause.

In setting the continuous paper 1 into the printing apparatus, the control section 100 moves the buffer roller 812 to a position where the buffer roller 812 and the continuous paper 1 do not interfere with each other.

Figure 12:
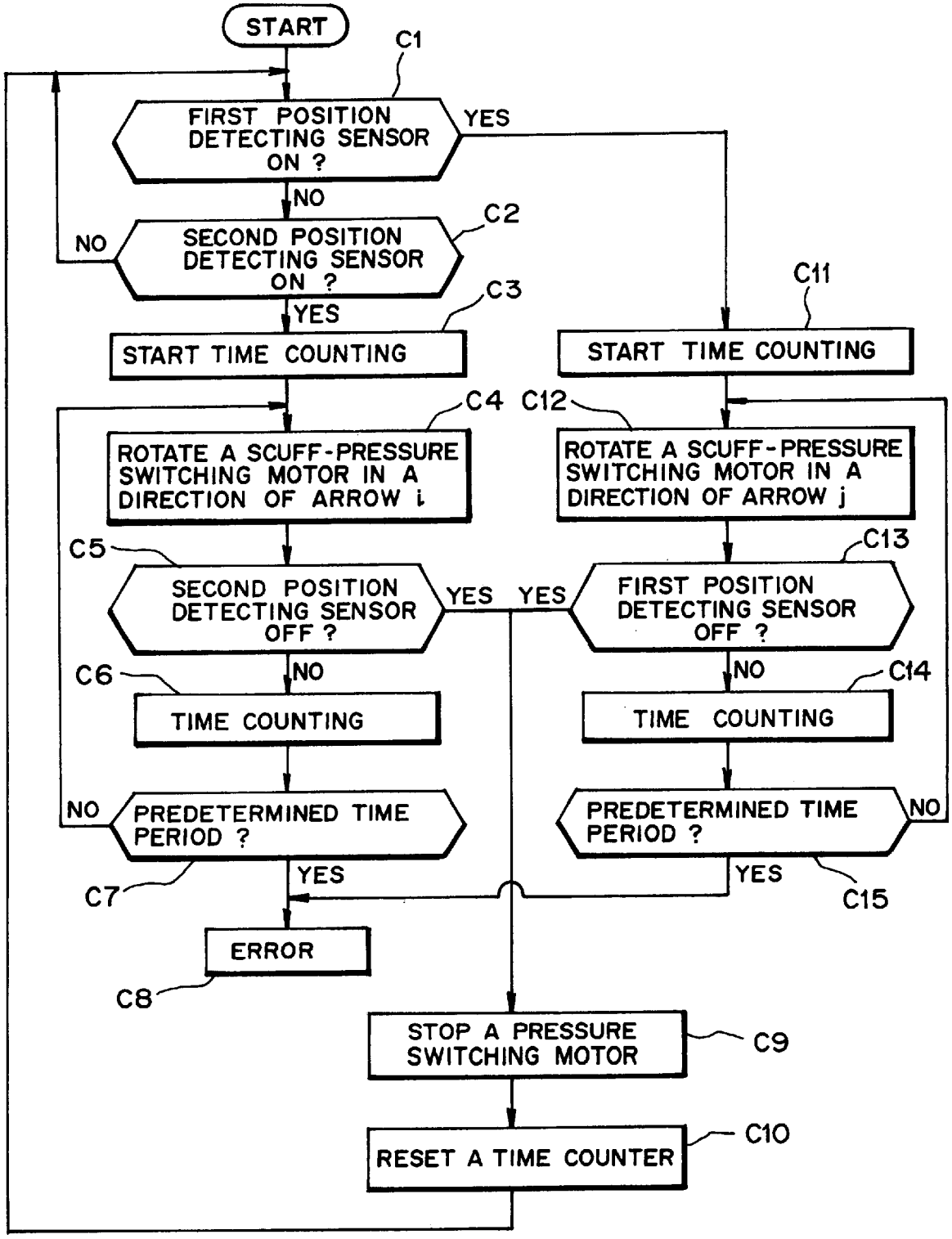
FIG. 12 is a flowchart showing how a feed-force adjustment section is controlled by the control section of the continuous medium printing apparatus of the third embodiment during printing.

The control of the feed-force adjustment section 830 by the control section 100 in the continuous medium printing apparatus during printing will hereinafter be described by the above-mentioned construction in accordance with a flowchart (steps C1 to C15) shown in FIG. 12.

The control section 100 judges if the first position detection sensor 821*a* has detected the light intercepting portion 823 (step C1). When the first position detection sensor 821*a* detects the light intercepting portion 823 (see route YES in step C1), the control section 100 resets a time counter to measure the continuous detection time period and then starts counting time (step C11).

And the control section 100 rotates the scuff-pressure switching motor 836 in the direction of increasing scuff pressure (in FIG. 9 the direction of arrow j) (step C12) and then confirms that the first position detection sensor 821*a* has not detected the light intercepting portion 823 any longer (step C13).

Here, when the first position detection sensor 821*a* has not detected the light intercepting portion 823 any longer (see route YES in step C13), the control section 100 stops the rotation of the scuff-pressure switching motor 836 (step C9), then resets the time counter (step C10), and returns to step C1 again.

When, on the other hand, the first position detection sensor 821*a* continues to detect the light intercepting portion 823 (see route NO in step C13), the control section 100 counts up the time counter (step C14) and then compares the value of the time counter with a previously set time period (e.g., 20 sec) (step C15).

When the time counter value is less than the predetermined time period (see route NO in step C15), the control section 100 returns to step C12. When, on the other hand, the time counter value reaches the predetermined time period (see route YES in step C15), the control section 100 judges that the continuous paper 1 cannot be tensioned any longer for some reason, such as the tear of the continuous paper 1, and displays an alarm representing that effect on the display 111 or the like (step C8).

When the first position detection sensor 821*a* has not detected the light intercepting portion 823 (see route NO in step C1), the control section 100 judges if the second position detection sensor 821*b* has detected the light intercepting portion 823 (step C2). When the second position detection sensor 821*b* detects the light intercepting portion 823 (see route YES in step C2), the control section 100 resets the time counter to measure the continuous detection time period and then starts counting time (step C3).

And the control section 100 rotates the scuff-pressure switching motor 836 in the direction of decreasing scuff pressure (in FIG. 9 the direction of arrow i) (step C4) and then confirms that the second position detection sensor 821*b* has not detected the light intercepting portion 823 any longer (step CS).

Here, when the second position detection sensor 821*b* has not detected the light intercepting portion 823 any longer (see route YES in step C5), the control section 100 stops the rotation of the scuff-pressure switching motor 836 (step C9), then resets the time counter (step C10), and returns to step C1 again.

When, on the other hand, the second position detection sensor 821*b* continues to detect the light intercepting portion 823 (see route NO in step C5), the control section 100 counts up the time counter (step C6) and then compares the value of the time counter with a previously set time period (e.g., 20 sec) (step C7).

When the time counter value is less than the predetermined time period (see route NO in step C7), the control section 100 returns to step C4. When, on the other hand, the time counter value reaches the predetermined time period (see route YES in step C7), the control section 100 judges that the tension in the continuous paper 1 cannot be removed because of the conveyance failure of the continuous paper 1 or the like, and displays an alarm representing that effect on the display 111 or the like (step C8).

When, on the other hand, the second position detection sensor 821*b* has not detected the light intercepting portion 823 (see route NO in step C2), the control section returns to step C1.

Thus, the continuous medium printing apparatus as the third embodiment of the present invention is capable of obtaining the following operational effects by the automatic feed-force adjustment unit 800 in addition to the same operational effect as the above-mentioned first embodiment.

That is, because the buffer section 810 can suck up the deflection of the continuous paper 1, the continuous paper 1 can be stretched with a constant tension, even if dust or the like on the surface of the continuous paper 1 varied the coefficient of friction.

In addition, because the deflection quantity detection section 820 detects the deflection of the continuous paper 1 which cannot be sucked up by the buffer section 810, the continuous paper 1 can be stretched more reliably.

Moreover, the deflection quantity detection section 820 detects the deflection quantity of the continuous paper 1, sucked up by the buffer section 810, as a quantity corresponding to feed force to be applied to the continuous paper 1, and when deflection is detected, the control section 100 varies the feed force (scuff force) to be applied to the continuous paper 1 by the feed-force adjustment section 830. Therefore, the tension in the continuous paper 1 can be adjusted in real time, and in the first transferring process unit 250 and the second transferring process unit 260, the continuous paper 1 can be stretched at all times with a constant tension and therefore printing quality can be enhanced.

The control section 100 also measures the continuous time period of detecting the light intercepting section 823 (second arm member 813) by the first position detection sensor 821*a* or the second position detection sensor 821*b*, and when the continuous detection time period exceeds a predetermined time period, the control section 100 gives an alarm to the operator, for example, by displaying that effect on the display 111. Therefore, the control section 100 can detect the state that the continuous medium cannot be tensioned because of the tear of the continuous medium or the like and the state that the tension in the continuous medium cannot be removed because of the conveyance failure of the continuous medium or the like. As a result, apparatus reliability can be enhanced and printing quality can be maintained.

The control section 100 also adjusts the angle of the buffer-pressure switching motor 817 in accordance with printing conditions for the continuous paper 1 input from the display 111 or the like, thereby varying the position of one end (in FIG. 9 the left end) of each second lever member 815 and varying the length of each buffer pressure spring 814. Therefore, even when duplex printing is performed on a different kind of continuous paper 1, the continuous paper 1 can be conveyed with buffer pressure corresponding to printing conditions for each continuous paper 1 (paper basis weight (paper thickness), paper stem, paper size, etc.) and the continuous paper 1 can always be stretched. As a result, printing quality can be enhanced.

Furthermore, the control section 100 measures the continuous time period of detecting the light intercepting section 823 (second arm member 813) by the first position detection sensor 821*a* or the second position detection sensor 821*b*, and when the continuous detection time period exceeds a predetermined time period, the control section 100 gives an alarm to the operator. With this, the control section 100 can detect the state that the continuous paper 1 cannot be tensioned because of the tear of the continuous paper 1 or the like and the state that the tension in the continuous paper 1 cannot be removed because of the conveyance failure of the continuous paper 1 or the like. Therefore, apparatus reliability can be enhanced and printing quality can be maintained.

Because the first position detection sensor 821*a* and the second position detection sensor 821*b* detect an overrun state by detecting the light intercepting portion 823 (second arm member 813), the overrun state can be detected with reliability. As a result, apparatus reliability can be enhanced and printing quality can be maintained.

Furthermore, the control section 100 receiving a detection signal from the home-position detection sensor 841 or the overrun detection sensor 842 outputs an alarm signal to the display 111, or a display (not shown), etc., and the home-position detection sensor 841 and the overrun detection sensor 842 detects an overrun state by the rotational angle of the buffer-pressure switching motor 817. Therefore, the overrun state can be detected with reliability. As a result, apparatus reliability can be enhanced and printing quality can be maintained.

Since the upper stopper 822*a* and the lower stopper 822*b* regulate the rotation of the second arm member 813 which exceeds an allowable value for the deflection quantity of the continuous paper 1, the detection of the position of the second arm member 813 by the first and second position detection sensors 821*a*, 821*b* becomes easy and there is no possibility that the excessive rotation of the second arm member 813 will interfere with other components. As a result, apparatus reliability can be enhanced.

In addition, the buffer roller 812 is disposed so that the buffer roller 812 and the continuous paper 1 do not interfere with each other between the driven roller 811*a* and the driven droller 811*b*, and when the continuous paper 1 is set into the printing apparatus, the control section 100 moves the buffer roller 812 to a position where the buffer roller 812 and the continuous paper 1 do not interfere with each other. Therefore, there is no possibility that when the continuous paper 1 is set into the printing apparatus, the continuous paper 1 will interfere with the buffer roller 812, and the setting of the continuous paper 1 is easy. As a result, the continuous paper 1 can be quickly set into the continuous medium printing apparatus.

(E) Others

In the above-mentioned embodiments, while the continuous paper 1 with the feed holes 1*b* has been described by employing the tractor mechanisms 72, 73, the present invention is not limited to this. The above-mentioned automatic feed-force adjustment unit 800 may be employed in a continuous medium printing apparatus that performs printing on pinless continuous paper having no feed holes. With this, there is no need to dispose tractor mechanisms at upstream and downstream positions of the paper conveying path from the photosensitive drums 211, 211 of the first and second transferring process units 250, 260. Therefore, even when printing is performed on pinless continuous paper having no feed holes, the behavior of the continuous paper in the first and second transferring process units 250, 260 can be suppressed.

In the above-mentioned third embodiment, the deflection quantity detection section 820 is constituted by the first position detection sensor 821*a* and the second position detection sensor 821*b*, and the control section 100 judges tear of the continuous paper 1 and excessive tension in the continuous paper 1 by analyzing the continuous time period of detecting the light intercepting portion 813 by the first position detection sensor 821*a* or the second position detection sensor 821*b*. However, the present invention is not limited to this example. For example, the control section 100 may judge the tear of the continuous paper 1 and the excessive tension in the continuous paper 1, by judging the rotational angle of the scuff-pressure switching motor 836 with the overrun detection sensor 842 or the like and then comparing the rotational angle of the scuff-pressure switching motor 836 with a predetermined value. With this, there is no need to provide the first position detection sensor 821*a* and the second position detection sensor 821*b*, and consequently, the cost for manufacturing the printing apparatus can be reduced.

Although the printing apparatus described in detail supra has been found to be most satisfactory and preferred, many variations in structure are possible. Because many variations and different embodiments may be made within the scope of the inventive concept herein taught, it should be understood that the details herein are to be interpreted as illustrative and not in a limiting sense.

For example, in the aforementioned embodiments, while two photosensitive drums 211, i.e., the upstream photosensitive drum 211 of the first transferring process unit 250 and the downstream photosensitive drum 211 of the second transferring process unit 260 have been disposed along the conveying path of the continuous paper 1 so that toner images are formed on the continuous paper 1, the present invention is not to be limited to the two photosensitive drums. For example, 3 or more photosensitive drums 211 may be disposed along the conveying path of the continuous paper 1 so that toner images are formed on the continuous paper 1.

In the aforementioned first embodiment, while the spring 786 has been interposed as an elastic member between the arm member 783 and the lever member 784, the elastic member is not limited to springs. For example, other elastic members, such as rubber and the like, may be interposed.

In the aforementioned third embodiment, although the pinch pressure spring 840 has been interposed as a first elastic member between the first arm member 832 and the first lever member 834 and also the buffer pressure spring 814 has been interposed as a second elastic member between the second arm member 813 and the second lever member 815, the first and second elastic members are not limited to springs. For example, other elastic members, such as rubber and the like, may be interposed.

What is claimed is:

1. A continuous medium printing apparatus for performing printing on both sides of a continuous medium, comprising:

a conveyance system for conveying said continuous medium along a conveying path;

a printing section for performing printing on said continuous medium being conveyed along said conveying path;

a feed-force adjustment section for adjusting feed force to be applied to said continuous medium, said feed-force adjustment section being disposed on a downstream side of said conveying path from said printing section; and a feed-force control section for controlling said feed-force adjustment section so that said feed force to be applied to said continuous medium varies according to a printing condition, wherein said conveyance system has a pair of conveyor rollers disposed on a downstream side of the conveying path from said printing section so that they are opposite to each other with said continuous medium therebetween, feed force being applied to said continuous medium by rotating said pair of conveyor rollers with said continuous medium clamped therebetween:

said feed-force adjustment section varies said feed force by adjusting pressure of said pair of conveyor rollers with respect to said continuous medium;

said pair of conveyor rollers is constituted by a scuff roller which conveys said continuous medium in sliding contact with said continuous medium and a pinch roller which clamps said continuous medium in cooperation with said scuff roller; and said feed-force adjustment section varies said feed force by adjusting pressure of said pinch roller with respect to said scuff roller so that scuff pressure of said scuff roller with respect to said continuous medium is adjusted, wherein said feed-force adjustment section is constituted by an arm member which freely rotatably supports said pinch roller and is pivotable on an arm shaft disposed in parallel with a rotating shaft of said pinch roller;

a lever member which is pivotable on a lever shaft disposed in parallel with said rotating shaft of said pinch roller;

an elastic member for applying said pressure to said pinch roller, said elastic member being interposed between said arm member and said lever member; and a drive mechanism which drives said lever member to rotate on said lever shaft in order to adjust said scuff pressure, by adjusting a rotational angle of said lever member.

2. The continuous medium printing apparatus set forth in claim 1, wherein said printing condition is a condition including characteristics of said continuous medium.

3. The continuous medium printing apparatus as set forth in claim 1, further comprising a printing condition obtaining section for obtaining a print area rate in said continuous medium as said printing condition.

4. The continuous medium printing apparatus as set forth in claim 1, further comprising a printing condition obtaining section for obtaining a time that said scuff roller has been used as said printing condition, wherein said pair of conveyor rollers is constituted by a scuff roller which conveys said continuous medium in sliding contact with said continuous medium and a pinch roller which clamps said continuous medium in cooperation with said scuff roller; and said feed-force adjustment section varies said feed force by adjusting pressure of said pinch roller with respect to said scuff roller so that scuff pressure of said scuff roller with respect to said continuous medium is adjusted, wherein said printing condition is the time that said scuff roller has been used.

5. A continuous medium printing apparatus for performing printing on a continuous medium, comprising:

a conveyance system for conveying said continuous medium along a conveying path;

a printing section for performing printing on said continuous medium being conveyed along said conveying path; and an automatic feed-force adjustment unit for automatically adjusting feed force to be applied to said continuous medium, said automatic feed-force adjustment unit being disposed along said conveying path;

wherein said automatic feed-force adjustment unit includes:

a buffer section for sucking up deflection of said continuous medium produced due to a change in said feed force to be applied to said continuous medium, said buffer section being disposed on a downstream side of said conveying path from said printing section;

a deflection quantity detection section for detecting a quantity of deflection of said continuous medium sucked up by said buffer section, as a quantity corresponding to said feed force to be applied to said continuous medium;

a feed-force adjustment section for adjusting said feed force to be applied to said continuous medium, said feed-force adjustment section being disposed on a downstream side of said conveying path from said deflection quantity detection section; and a feed-force control section for controlling said feed-force adjustment section so that said feed force to be applied to said continuous medium varies according to said deflection quantity detected by said deflection quantity detection section.

6. The continuous medium printing apparatus as set forth in claim 5, wherein said conveyance system has a pair of conveyor rollers disposed on a downstream side of said conveying path from said deflection quantity detection section so that they are opposite to each other with said continuous medium therebetween, feed force being applied to said continuous medium by rotating said pair of conveyor rollers with said continuous medium clamped therebetween; and said feed-force adjustment section varies said feed force by adjusting pressure of said pair of conveyor rollers with respect to said continuous medium.

7. The continuous medium printing apparatus as set forth in claim 6, wherein said pair of conveyor rollers is constituted by a scuff roller which conveys said continuous medium in sliding contact with said continuous medium and a pinch roller which clamps said continuous medium in cooperation with said scuff roller; and said feed-force adjustment section varies said feed force by adjusting pressure of said pinch roller with respect to said scuff roller so that scuff pressure of said scuff roller with respect to said continuous medium is adjusted.

8. The continuous medium printing apparatus as set forth in claim 7, wherein said feed-force adjustment section is constituted by a first arm member which freely rotatably supports said pinch roller and is pivotable on a first arm shaft disposed in parallel with a rotating shaft of said pinch roller;

a first lever member which is pivotable on a first lever shaft disposed in parallel with said rotating shaft of said pinch roller;

a first elastic member for applying said pressure, said first elastic member being interposed between said first arm member and said first lever member; and a first drive mechanism which drives said first lever member to rotate on said first lever shaft in order to adjust said scuff pressure, by adjusting a rotational angle of said first lever member.

9. The continuous medium printing apparatus as set forth in claim 8, wherein said buffer section is constituted by a buffer roller resting on one side of said continuous medium so as to be movable radially to absorb possible deflection of said continuous medium and so as to be rollable as a follower on the one side surface of said continuous medium in response to the conveyance of said continuous medium;

a pair of driven rollers resting on the another side of said continuous medium so as to be rollable as a follower on the another side surface of said continuous medium in response to the conveyance of said continuous medium; and an urging mechanism for urging said buffer roller in said direction of deflection in order to apply buffer pressure to said continuous medium in said direction of deflection.

10. The continuous medium printing apparatus as set forth in claim 9, further comprising a buffer-pressure adjustment section for adjusting said buffer pressure which is applied to said continuous medium by said buffer roller, wherein said buffer-pressure adjustment section is constituted by a second arm member which freely rotatably supports said buffer roller and is pivotable on a second arm shaft disposed in parallel with a rotating shaft of said buffer roller;

a second lever member which is pivotable on a second lever shaft disposed in parallel with said rotating shaft of said buffer roller;

a second elastic member for applying said buffer pressure, said second elastic member being interposed between said second arm member and said second lever member; and a second drive mechanism which drives said second lever member to rotate on said second lever shaft in order to adjust said buffer pressure, by adjusting a rotational angle of said second lever member;

said second arm member, said second lever member, and said second elastic member also constituting said urging mechanism.

11. The continuous medium printing apparatus as set forth in claim 10, wherein said deflection quantity detection section is constituted by a position detection sensor which detects a position of said second arm member as a position of said buffer roller.

12. The continuous medium printing apparatus as set forth in claim 11, wherein said position detection sensor is constituted by a first position detection sensor which detects that said second arm member has reached an upper limit position corresponding to the case where the deflection quantity of said continuous medium has gone to a predetermined upper value and a second position detection sensor which detects that said second arm member has reached a lower limit position corresponding to the case where the deflection quantity of said continuous medium has gone to a predetermined lower value; and said feed-force control section controls said feed-force adjustment section so that said scuff pressure is increased when said first position detection sensor detects said second arm member and is decreased when said second position detection sensor detects said second arm member.

13. The continuous medium printing apparatus as set forth in claim 12, wherein said feed-force control section measures a continuous time period of detecting said second arm member by said first position detection sensor or said second position detection sensor and gives an alarm when said continuous detection time period exceeds a predetermined time period.

14. The continuous medium printing apparatus as set forth in claim 10, further comprising an overrun sensor which detects that the deflection quantity of said continuous medium has gone to an overrun state exceeding an allowable value;

wherein said feed-force control section gives an alarm when said overrun sensor detects said overrun state.

15. The continuous medium printing apparatus as set forth in claim 14, wherein said overrun sensor detects said overrun state by a rotational angle of said second drive mechanism.

16. A continuous medium printing apparatus for performing printing on both sides of a continuous medium, comprising:

a conveyance system including means for applying a feed force to said continuous medium for conveying said continuous medium along a conveying path;

a printing section for performing printing on said continuous medium being conveyed along said conveying path;

a printing condition obtaining section for obtaining a printing area rate in said continuous medium as said printing condition;

a feed-force adjustment section for adjusting the feed force applied to said continuous medium, said feed-force adjustment section being disposed on a downstream side of said conveying path from said printing section; and a feed-force control section containing means for controlling said feed-force adjustment section in such a manner that said feed force applied to said continuous medium varies according to said printing condition so as to increase when the printing area rate is high and decrease when the printing area rate is low.

17. A continuous medium printing apparatus for performing printing on both sides of a continuous medium, comprising:

a conveying system including means for applying a feed force to said continuous medium for conveying said continuous medium along a conveying path;

a printing section for performing printing on said continuous medium being conveyed along said conveying path;

a printing condition obtaining section for obtaining a time that a scuff roller has been used as said printing condition;

a feed-force adjustment section for adjusting the feed force applied to said continuous medium, said feed-force adjustment section being disposed on a downstream side of said conveying path from said printing section; and a feed-force control section containing means for controlling said feed-force adjustment section in such a manner that said feed force applied to said continuous medium varies according to said printing condition so as to increase when the time that said scuff roller has been used is long and decreases when the time that said scuff roller has been used is short.

* * * * *